US009882295B2

(12) United States Patent
Miura et al.

(10) Patent No.: US 9,882,295 B2
(45) Date of Patent: Jan. 30, 2018

(54) CONNECTOR

(71) Applicant: YAZAKI CORPORATION, Tokyo (JP)

(72) Inventors: Kazunori Miura, Shizuoka (JP); Kouichi Ohyama, Shizuoka (JP); Keigo Tsubo, Shizuoka (JP); Shingo Chiba, Shizuoka (JP); Yasushi Takanashi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 1 day.

(21) Appl. No.: 15/257,520

(22) Filed: Sep. 6, 2016

(65) Prior Publication Data

US 2017/0069984 A1 Mar. 9, 2017

(30) Foreign Application Priority Data

Sep. 7, 2015 (JP) ..... 2015-175851
Apr. 12, 2016 (JP) ..... 2016-079773

(51) Int. Cl.
*H01R 12/70* (2011.01)
*H01R 12/72* (2011.01)
*H01R 13/41* (2006.01)

(52) U.S. Cl.
CPC ..... *H01R 12/7005* (2013.01); *H01R 12/724* (2013.01)

(58) Field of Classification Search
CPC .. H01R 12/724; H01R 12/58; H01R 12/7005; H01R 12/7011; H01R 12/7052; H01R 12/7064; H01R 12/707; H01R 12/712; H01R 13/405; H01R 13/41; H05K 3/306
See application file for complete search history.

(56) References Cited

U.S. PATENT DOCUMENTS 4,986,772 A * 1/1991 Fukutani ..... H01R 12/724 174/138 G
5,409,384 A * 4/1995 Green ..... H01R 12/777 439/67
5,540,598 A * 7/1996 Davis ..... H01R 12/724 439/79

(Continued)

FOREIGN PATENT DOCUMENTS

JP 5030159 B2 9/2012
JP 2014-211979 A 11/2014

*Primary Examiner* — James Harvey
*Assistant Examiner* — Matthew T Dzierzynski
(74) *Attorney, Agent, or Firm* — Kenealy Vaidya LLP

(57) ABSTRACT

A connector includes a housing, a plurality of terminals installed in the housing, and an aligning plate configured to be installed in the housing and having a plurality of positioning holes. The connector is configured to be mounted on a circuit board so that the terminals inserted into the positioning holes are inserted into the through holes of the circuit board. The aligning plate has a first face and a second face on the opposite side of the first face, the second face being opposed to the circuit board during mounting onto the circuit board. The aligning plate has a stepped shape including a plurality of faces being different in position in the mounting direction toward the circuit board on the first face. The aligning plate has a relief section provided on the second face.

8 Claims, 29 Drawing Sheets

(56) References Cited

U.S. PATENT DOCUMENTS

| | | | | |
|---|---|---|---|---|
| 5,591,036 | A * | 1/1997 | Doi | H01R 12/724 439/79 |
| 5,906,518 | A * | 5/1999 | Sun | H01R 13/193 439/295 |
| 6,077,092 | A * | 6/2000 | Chiu | H01R 12/724 439/79 |
| 6,159,040 | A * | 12/2000 | Chang | H01R 12/716 439/541.5 |
| 6,171,116 | B1 * | 1/2001 | Wicks | H01R 12/724 439/79 |
| 6,203,374 | B1 * | 3/2001 | Huang | H01R 12/707 439/571 |
| 7,018,237 | B2 * | 3/2006 | Zhan | H01R 13/65802 439/567 |
| 7,517,232 | B2 * | 4/2009 | Yuan | H01R 12/716 439/79 |
| 2003/0166348 | A1 * | 9/2003 | Martin | H01R 12/724 439/79 |
| 2010/0300723 | A1 | 12/2010 | Ambo et al. | |

* cited by examiner

CONNECTOR

CROSS REFERENCE TO RELATED APPLICATIONS

This application is based on Japanese Patent Application (No. 2015-175851) filed on Sep. 7, 2015 and Japanese Patent Application (No. 2016-079773) filed on Apr. 12, 2016, the contents of which are incorporated herein by reference.

The present invention relates to a connector equipped with a plurality of terminals.

A board-mounting connector to be mounted onto a circuit board is equipped with a plurality of terminals to be inserted into a plurality of through holes in the circuit board and to be soldered to conductor patterns on the circuit board. For example, a conventional board-mounting connector (hereafter referred to as a "conventional connector") is equipped with an aligning plate for aligning (arranging) the terminals at positions appropriate for insertion into the through holes. By virtue of this aligning plate, the respective terminals are smoothly guided to the corresponding through holes in the circuit board during mounting onto the circuit board (for example, refer to JP-A-2014-211979 and JP-B-5030159).

The above-mentioned aligning plate for positioning the terminals, however, has a plurality of positioning holes into which the terminals are inserted so as to be supported. However, if the number of the positioning holes (the density of the positioning holes) for the aligning plate becomes excessively large due to a request or the like for mounting numerous parts on a circuit board at high density (hereafter referred to as "high-density mounting"), degradation in strength and warping during molding, for example, may occur in the aligning plate, and the positioning accuracy of the terminals may be degraded in some cases.

Furthermore, for the purpose of avoiding the aligning plate from making contact (interfering) with another part (mounting component) mounted on the circuit board, the other part is disposed away from the periphery of the aligning plate (or the connector to which the aligning plate is attached). However, from the viewpoint of high-density mounting, it is desirable that the mountable region of the circuit board including the periphery of the aligning plate (or the connector) should be as wide as possible.

SUMMARY OF THE INVENTION

The present invention has been made in consideration of the above-mentioned circumstances, and an object of the present invention is to provide a connector characterized in that high-density mounting onto a circuit board can be made while excellent positioning accuracy is secured.

To attain the above-mentioned object, the connector according to the present invention is characterized as described in the following items (1) to (8).

(1) A connector including a housing, a plurality of terminals installed in the housing, and an aligning plate configured to be installed in the housing and having a plurality of positioning holes into which the terminals are inserted, wherein the connector is configured to be mounted on a circuit board so that the terminals inserted into the positioning holes are inserted into the through holes of the circuit board, wherein the aligning plate has a first face and a second face on the opposite side of the first face, the second face being opposed to the circuit board during mounting onto the circuit board; wherein the aligning plate has a stepped shape including a plurality of faces being different in position in the mounting direction toward the circuit board on the first face; and wherein the aligning plate has a relief section provided on the second face to avoid interference with a mounting component on the circuit board.

(2) The connector described in the above-mentioned item (1), wherein the aligning plate has a concave section serving as the relief section and is provided on the second face at the position opposed to the mounting component; and wherein the aligning plate has a convex-shaped section having the stepped shape and is provided on the first face at a position corresponding to the concave section.

(3) The connector described in the above-mentioned item (2), wherein during mounting onto the circuit board, the second face other than the concave section in the aligning plate is positioned closer to the surface of the circuit board than the upper face of the mounting component and also positioned more away from the surface of the circuit board than solder fillet sections formed around the through holes of the circuit board; and wherein during mounting onto the circuit board, the concave section of the second surface in the aligning plate is positioned more away from the circuit board than the upper face of the mounting component.

(4) The connector described in any one of the above-mentioned items (1) to (3), wherein the aligning plate has a plate shape; wherein the stepped shape is a shape in which plural faces being different in position in the mounting direction are arranged in the width direction of the aligning plate; and wherein the positioning holes are provided in the respective faces constituting the stepped shape.

(5) The connector described in any one of the above-mentioned items (1) to (3), wherein the aligning plate has a plate shape; wherein the stepped shape is a shape in which plural faces being different in position in the mounting direction are arranged in the depth direction orthogonal to the width direction of the aligning plate; and wherein the positioning holes are provided in the respective faces constituting the stepped shape.

(6) The connector described in any one of the above-mentioned items (1) to (5), wherein the aligning plate has a plate shape and also has wall sections protruding from the first face along the mounting direction and extending in the width direction of the aligning plate; and wherein the positioning holes are arranged along the wall sections in the width direction of the aligning plate.

(7) The connector described in any one of the above-mentioned items (1) to (6), wherein the aligning plate has a plate shape and also has one or more through holes; wherein the housing has one or more protruding sections protruding along the mounting direction at the positions corresponding to the through holes on the second face; and wherein each of the one or more protruding sections has a first step section having a diameter corresponding to a diameter of the through hole and a second step section having a diameter corresponding to a diameter of the mounting hole provided in the circuit board.

(8) The connector described in any one of the above-mentioned items (1) to (7), wherein each of the positioning holes has a shape in which an opening area on the second face is smaller than an opening area on the first face and has a wall face which connects an opening edge on the first face to an opening edge on the second face or to a wall face portion in the vicinity of the opening edge on the second face and which is inclined with respect to the mounting direction.

With the connector configured as described in the above-mentioned item (1), by virtue of the stepped shape provided on the first face of the aligning plate, the strength, rigidity, etc. of the aligning plate are enhanced in comparison with the case in which the stepped shape does not exist (for example, the first face is flat). Hence, even if numerous positioning holes are provided in the aligning plate, degradation in strength and warping during molding hardly occur in comparison with the case in which the stepped shape does not exist. Furthermore, by virtue of the relief section (for example, a hollow section or the like into which the mounting component enters) provided on the second face of the aligning plate, the mounting component can be disposed closer to the mounting position of the connector (the aligning plate) on the circuit board than in the case in which the relief section does not exist. Hence, the circuit board can securely obtain a wider mountable region than in the case in which the relief section does not exist.

Therefore, with the connector having this configuration, high-density mounting onto a circuit board can be made while excellent positioning accuracy is secured.

With the connector configured as described in the above-mentioned item (2), since the concave section on the second face corresponds to the convex section on the first face, both the improvement in the strength and the like of the aligning plate and the acquisition of the relief section for the mounting component can be attained while preventing the shape of the aligning plate from becoming excessively complicated. Hence, with the connector having this configuration, high-density mounting onto the circuit board can be made while excellent positioning accuracy is secured without making the shape of the aligning plate excessively complicated.

With the connector configured as described in the above-mentioned item (3), when the connector is mounted onto the circuit board, the aligning plate can be brought close to the circuit board as much as possible while avoiding not only the interference between the aligning plate and the mounting component but also the interference between the aligning plate and the solder fillet sections. Hence, with the connector having this configuration, high-density mounting on the circuit board can be made while excellent positioning accuracy is secured and the thickness of the aligning plate (and eventually the connector) in the mounting direction is made small.

With the connector configured as described in the above-mentioned item (4), the faces being plural in number and constituting the stepped shape are arranged in the width direction of the aligning plate, and the positioning holes being plural in number are formed in the respective faces being different in position (in other words, in height) in the mounting direction. Hence, when the terminals are inserted into the positioning holes in a state in which the first face of the aligning plate is directed toward the terminals, the insertion of the terminals for the respective faces (steps) is performed sequentially starting from the positioning holes formed in the face (step) nearest to the terminals. Hence, the number of the terminals to be inserted into the positioning holes simultaneously is reduced in comparison with the case that the stepped shape does not exist on the first face (in other words, in the case that all the terminals are inserted into the positioning holes at a time). Furthermore, when some of the terminals have been inserted into the positioning holes, the remaining terminals are apt to be disposed in the vicinity of the corresponding positioning holes. Hence, the insertion operation of the terminals into the aligning plate is made easy and the time required to assemble the aligning plate on the housing can be shortened.

With the connector configured as described in the above-mentioned item (5), the faces being plural in number and constituting the stepped shape are arranged in the depth direction of the aligning plate, and the positioning holes being plural in number are formed in the respective faces being different in position (in other words, in height) in the mounting direction. Hence, in a similar way as described above, when the terminals are inserted into the positioning holes in a state in which the first face of the aligning plate is directed toward the terminals, the insertion of the terminals for the respective faces (steps) is performed sequentially starting from the positioning holes formed in the face (step) nearest to the terminals. Hence, the number of the terminals to be inserted into the positioning holes simultaneously can be reduced in comparison with the case that the stepped shape does not exist on the first face (in other words, in the case that all the terminals are inserted into the positioning holes at a time). Furthermore, when some of the terminals have been inserted into the positioning holes, the remaining terminals are apt to be disposed in the vicinity of the corresponding positioning holes. Hence, the insertion operation of the terminals into the aligning plate is made easy and the time required to assemble the aligning plate on the housing can be shortened.

With the connector configured as described in the above-mentioned item (6), the positioning holes are arranged along the wall sections extending in the width direction of the first face. Hence, when the terminals are inserted into the positioning holes in a state in which the first face is directed toward the terminals, the terminals can be guided to the positioning holes by sliding the terminals toward the positioning holes along the side faces of the wall sections while maintaining the aligning plate in a tilted state. Hence, the insertion operation of the terminals into the aligning plate is made easy and the time required to assemble the aligning plate on the housing can be shortened in comparison with the case in which these wall sections do not exist.

With the connector configured as described in the above-mentioned item (7), when the connector is mounted on the circuit board, the protruding section formed on the housing can be passed through the through hole formed in the aligning plate and then inserted into the mounting hole formed in the circuit board. Hence, the housing, the aligning plate and the circuit board are fixed to one another by using the engaging structure (the protruding section) common to them. Hence, the connector can be made compact and the cost of the connector can be reduced in comparison with the case in which the housing, the aligning plate and the circuit board are fixed using separated engaging structures. Furthermore, since assembling errors can be made small, the positional displacement between the through hole of the circuit board and the terminal can be reduced, and the work for mounting the connector is made easy.

With the connector configured as described in the above-mentioned item (8), the wall face (the inner wall face) of the positioning hole is an inclined face extending from the opening edge of the first face to the opening edge (or the vicinity thereof) of the second face. Hence, in comparison with the conventional connectors and the like, the inclination angle of the wall face of the positioning hole with respect to the mounting direction of the connector can be minimized (or substantially minimized) without changing the opening areas of the positioning hole on the first face and the second face (in other words, without significantly changing the entire structure of the aligning plate). When the terminal is inserted into the positioning hole, as the inclination angle of the wall face of the positioning hole is smaller, the friction force between the tip end of the terminal and the wall face of the positioning hole can be made smaller. Hence, with the connector having this configuration, the aligning plate can be easily assembled with the terminals (and eventually with the housing), and assembling workability can be improved. In particular, this easiness of the assembling work contributes to the improvement in the workability more greatly as the number of the terminal is larger (because the problem in which the total of the friction forces becomes excessive and the assembling work itself of the aligning plate becomes impossible can be prevented).

In view of minimizing the inclination angle of the wall face of the positioning hole, it is preferable that the wall face (the inner wall face) of the positioning hole should be an inclined face extending from the opening edge of the first face to the opening edge of the second face (in other words, the wall face of the positioning hole should be wholly inclined with respect to the mounting direction). On the other hand, in view of enhancing the positioning accuracy by preventing the deformation (in particular, the scraping of the opening edge of the second face and the like) of the wall face of the positioning hole due to the contact between the wall face and the terminal, it is preferable that the wall face (the inner wall face) of the positioning hole should be an inclined face extending from the opening edge of the first face to the vicinity of the opening edge of the second face (in other words, an uninclined wall face slightly exists in the vicinity of the opening edge of the second face).

The present invention can provide a connector characterized in that high-density mounting onto a circuit board can be made while excellent positioning accuracy is secured.

The present invention has been described above briefly. Moreover, the details of the present invention will be further clarified by reading the descriptions of the modes (hereafter referred to as "embodiments") for embodying the invention to be described below by referring to the accompanying drawings.

BRIEF DESCRIPTION OF THE DRAWINGS

FIG. 36A is a plan view showing the aligning plate, FIG. 36B is a cross-sectional view taken on line G-G of FIG. 36A, and FIG. 36C is an enlarged view of portion H of FIG. 36B;

DETAILED DESCRIPTION OF THE EXEMPLARY EMBODIMENTS

Connectors according to embodiments (first to fifth embodiments) of the present invention will be described below referring to the accompanying drawings.

First Embodiment

First, a connector according to a first embodiment will be described below.

Figure 1:
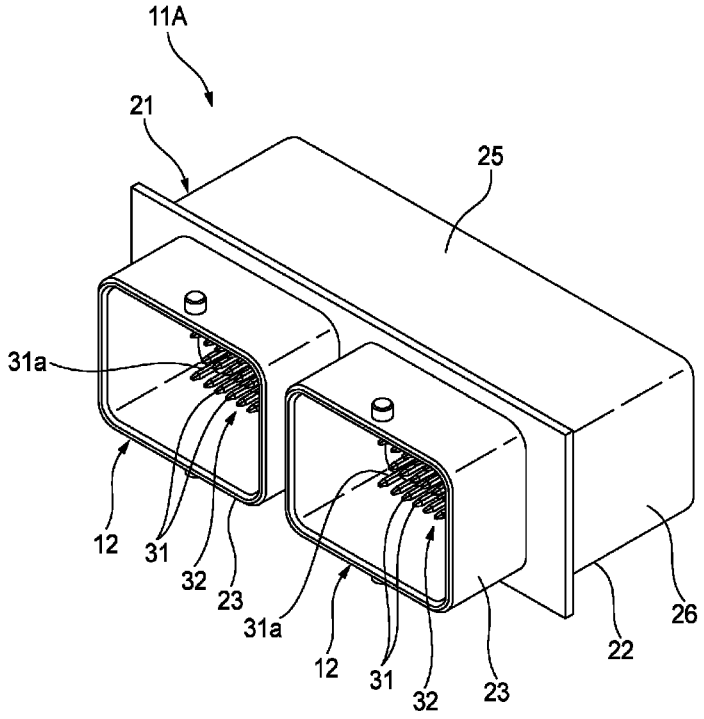
FIG. 1 is a perspective view showing a connector according to a first embodiment as viewed from the front.
Figure 2:
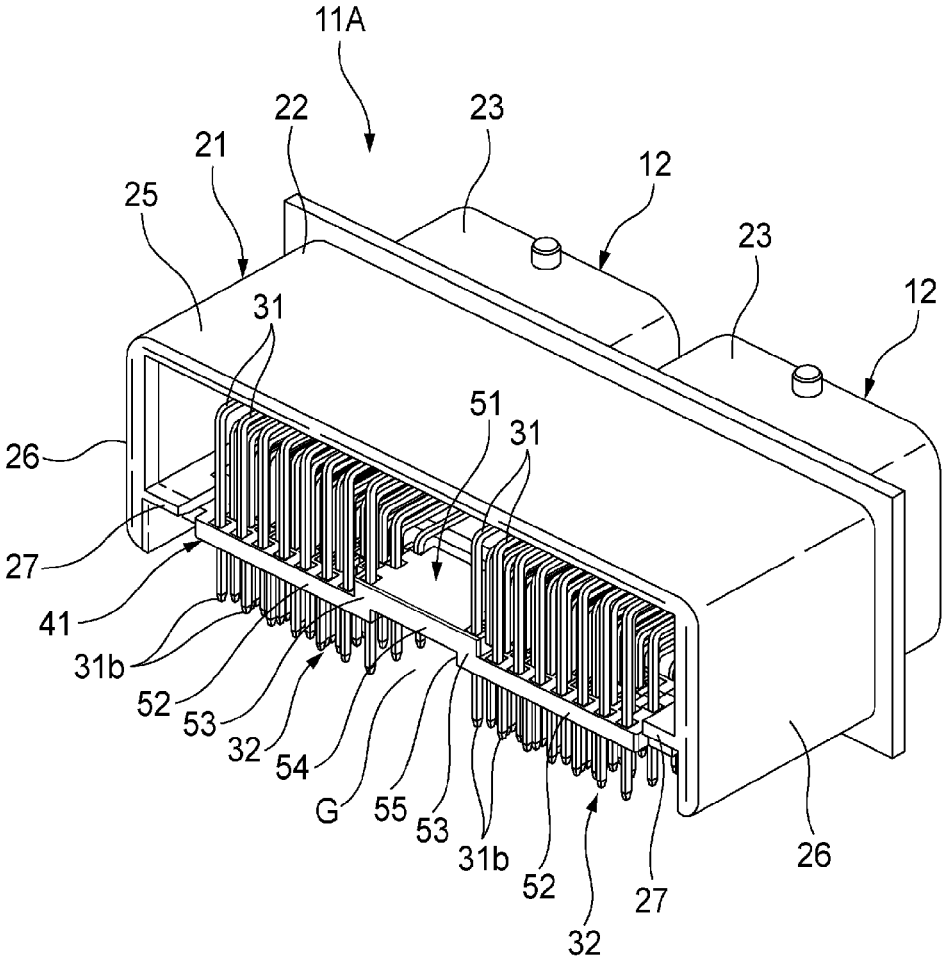
FIG. 2 is a perspective view showing the connector according to the first embodiment as viewed from the rear.
Figure 3:
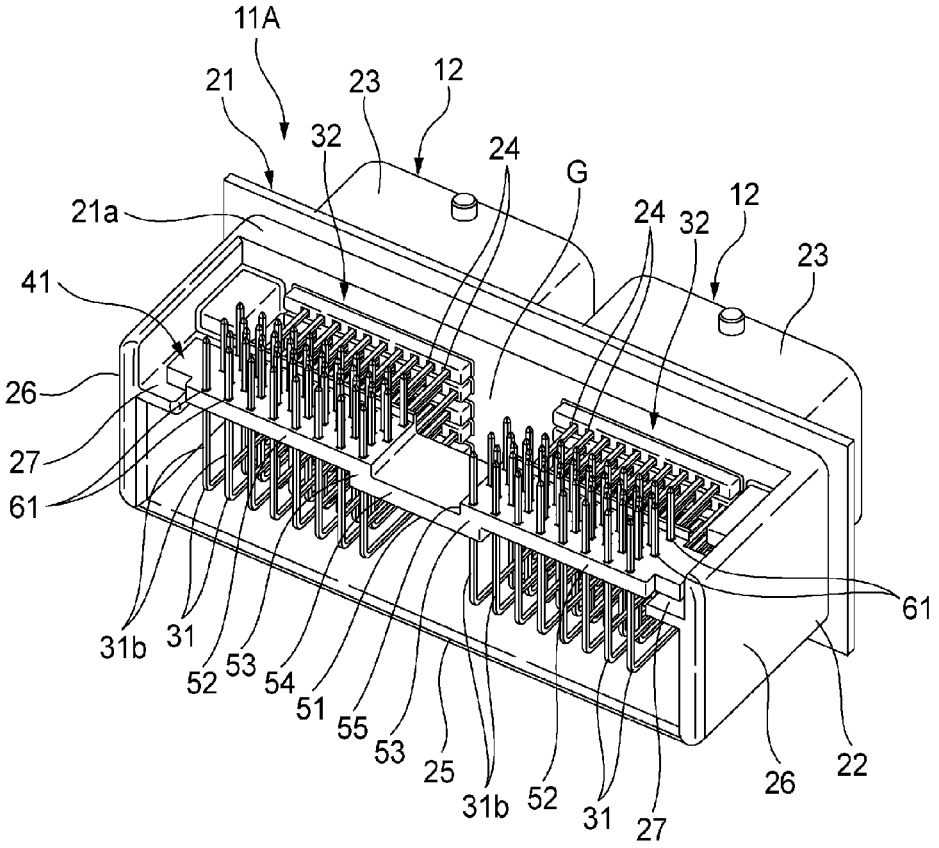
FIG. 3 is a bottom-side perspective view showing the connector according to the first embodiment as viewed from the rear.
Figure 4:
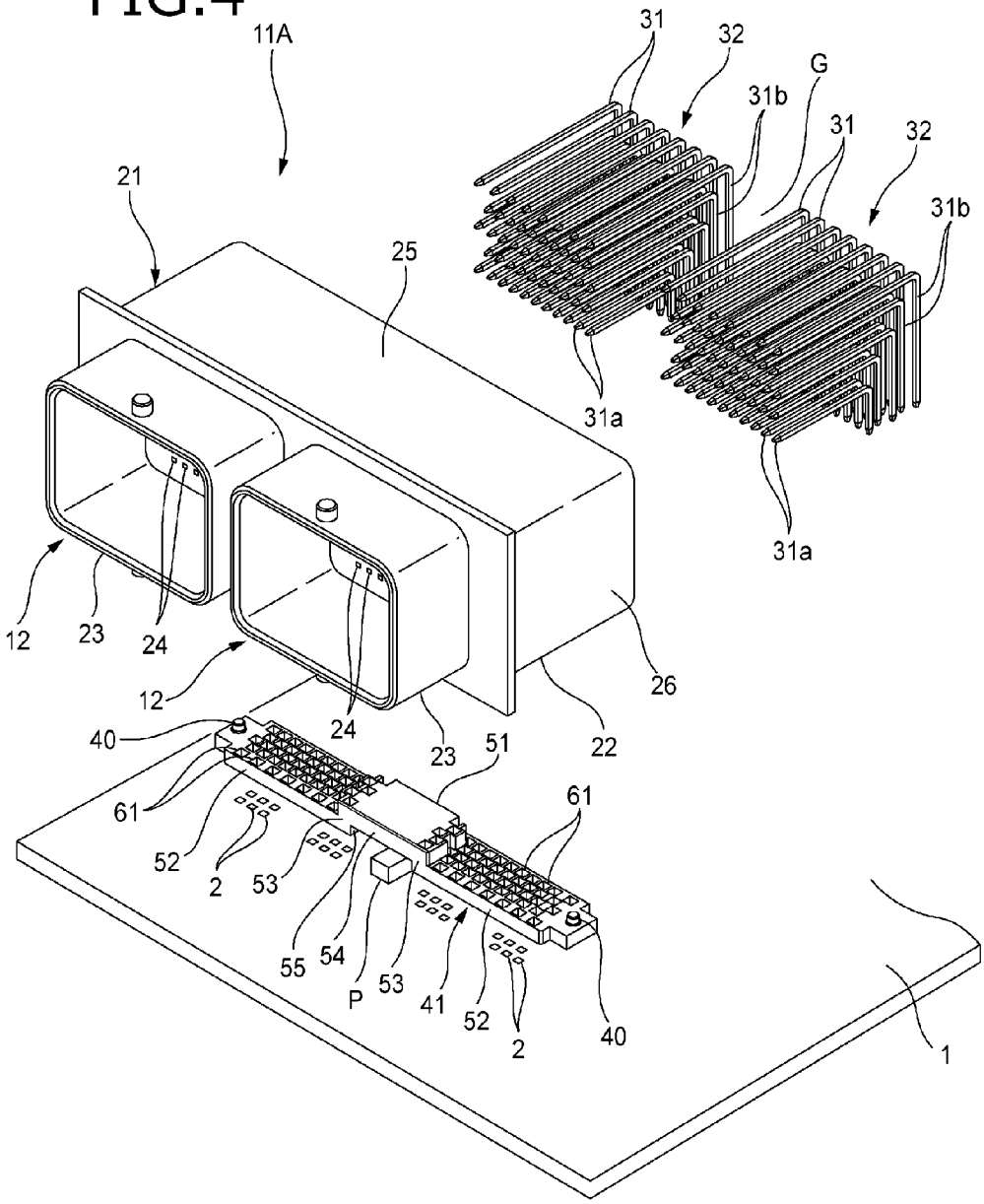
FIG. 4 is an exploded perspective view showing the connector according to the first embodiment.

FIG. 1 is a perspective view illustrating the connector according to the first embodiment as viewed from the front. FIG. 2 is a perspective view illustrating the connector according to the first embodiment as viewed from the rear. FIG. 3 is a bottom-side perspective view illustrating the connector according to the first embodiment as viewed from the rear. FIG. 4 is an exploded perspective view showing the connector according to the first embodiment.

As shown in FIGS. 1 to 4, a connector 11A according to the first embodiment is a board-mounting connector to be mounted onto a circuit board 1. This connector 11A is equipped with a housing 21, a plurality of terminals 31 and an aligning plate 41, and has two joint sections 12 to which a mating connector is joined.

The housing 21 is formed of resin (for example, molded by injection molding). The housing 21 has a terminal holding section 22 and two hood sections 23. The terminal holding section 22 has a plurality of press-fitting holes 24. The connection terminal section 31*a* (described later) of a terminal 31 is press-fitted into the press-fitting hole 24 from behind. The hood section 23 is formed into a squarely cylindrical shape, and the housing of the mating connector is fitted into the hood section 23.

An upper face plate 25 for covering the upper portions of the plurality of terminals 31 and side face plates 26 for covering both sides of the plurality of terminals 31 are provided on the rear side of the terminal holding section 22. Each of the side face plates 26 has a plate fixing face 27 in the vicinity of the bottom face 21*a* of the housing 21 on each side of the inner faces thereof opposed to each other. Both sides of the aligning plate 41 are fixed to the plate fixing faces 27. A fitting concave section (not shown) is formed on the lower face side of the plate fixing face 27.

The terminal 31 is made of a conductive metal material, such as copper or copper alloy, and is formed into a rod shape. The terminal 31 is formed into a quadrilateral shape in cross section. In this embodiment, the terminal 31 is formed into a square shape in cross section. One end side of the terminal 31 is the connection terminal section 31*a*, and the other end side thereof is a mounting terminal section 31*b*. The terminal 31 is bent into an L-shape in side view, and the mounting terminal section 31*b* is extended in the direction orthogonal to the connection terminal sections 31*a*.

The connection terminal section 31*a* of the terminal 31 is press-fitted into the press-fitting hole 24 formed in the terminal holding section 22 of the housing 21 from the rear side of the housing 21 in a state in which the mounting terminal section 31*b* is directed toward the bottom face 21*a* of the housing 21. Hence, the connection terminal section 31*a* of the terminal 31 is disposed inside the hood section 23, and the mounting terminal section 31*b* is protruded below the bottom face 21*a* of the housing 21. The connection terminal sections 31*a* of the terminals 31 are arranged in the front-rear and left-right directions (the up-down direction and the width direction) inside the hood section 23 of the housing 21. The mounting terminal sections 31*b* of the terminals 31 are arranged in the front-rear and left-right directions (the depth direction and the width direction) of the housing 21. The end sections of the connection terminal sections 31*a* of the terminals 31 are disposed in the same plane, and the end sections of the mounting terminal sections 31*b* of the terminals 31 are also disposed in the same plane. These terminals 31 may be integrated with the terminal holding section 22 of the housing 21 by insert molding when the housing 21 is molded.

The terminals 31 are divided into two terminal groups 32 constituting the two joint sections 12. The two joint sections 12 are provided with a space therebetween. Hence, a gap G is also formed between the terminal groups 32 respectively constituting the joint sections 12.

The aligning plate 41 is formed of resin and is also formed into a narrow flat plate shape. The aligning plate 41 is fixed to the plate fixing faces 27 on the side of the bottom face 21*a* of the housing 21. Furthermore, the aligning plate 41 is disposed along the bottom face 21*a* of the housing 21 in a state of being installed on the housing 21.

Figure 5:
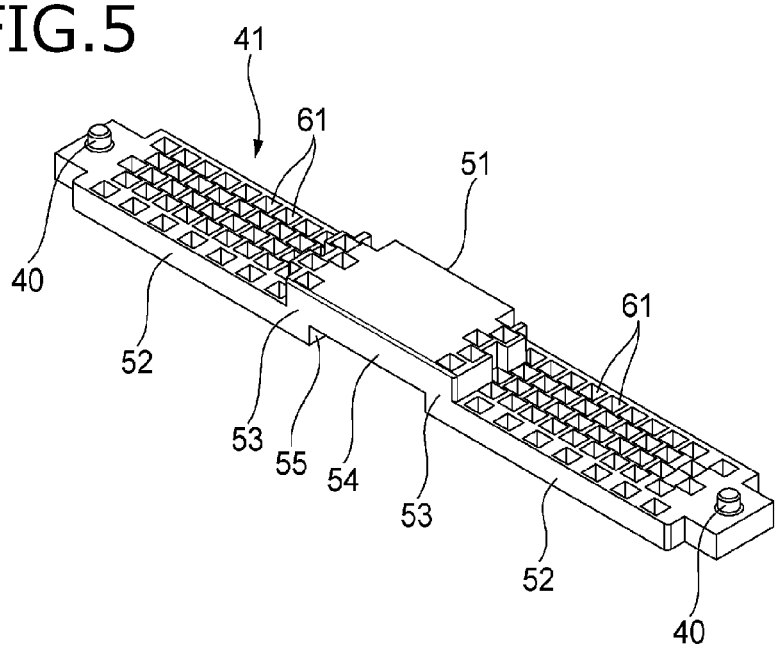
FIG. 5 is a perspective view showing an aligning plate constituting the connector.
Figure 6:
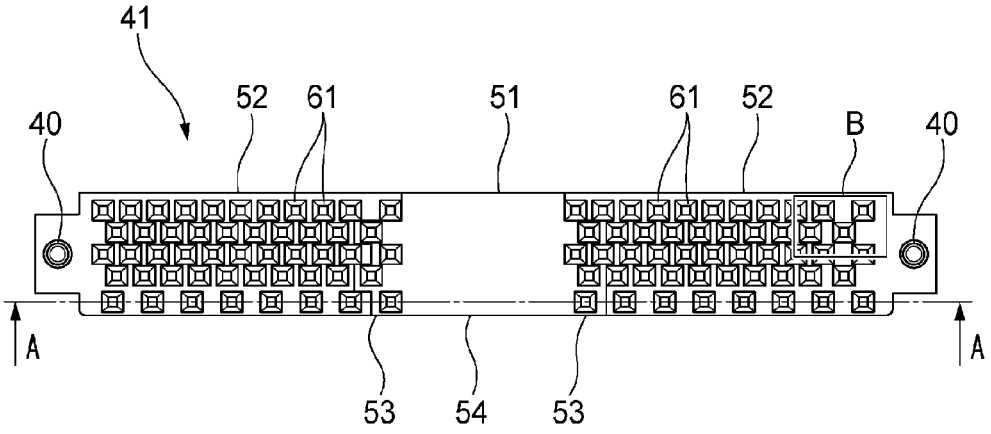
FIG. 6 is a plan view showing the aligning plate constituting the connector.
Figure 7:
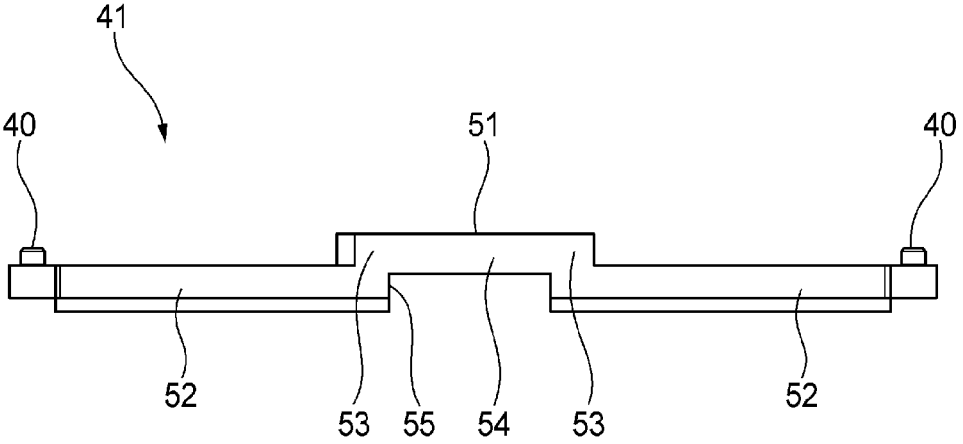
FIG. 7 is a side view showing the aligning plate constituting the connector.
Figure 8:
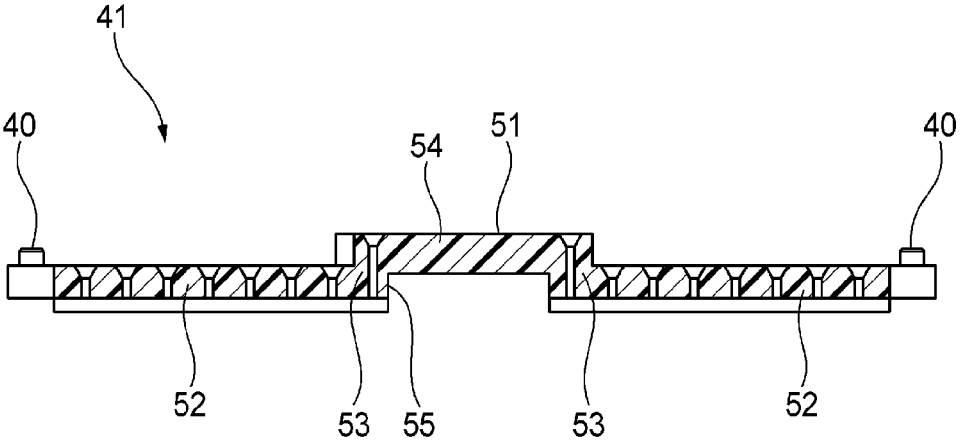
FIG. 8 is a cross-sectional view taken on line A-A of FIG. 6.
Figure 9:
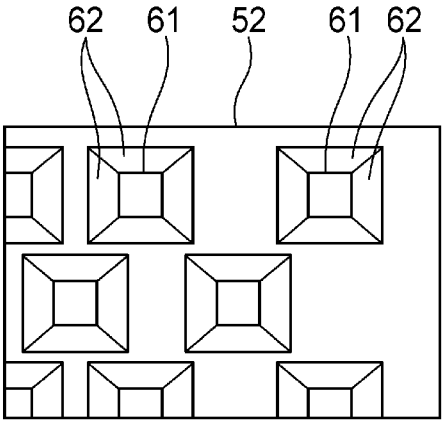
FIG. 9 is an enlarged view of portion B of FIG. 6.
Figure 10A:
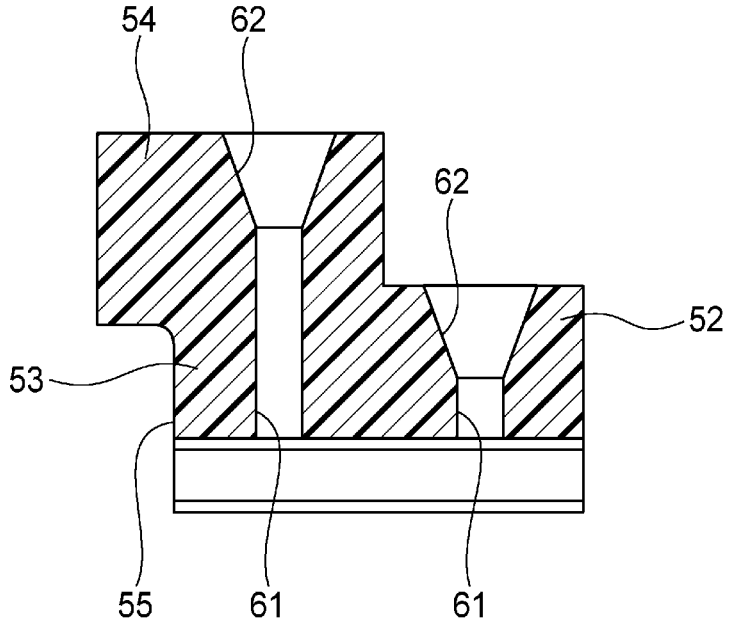
FIGS. 10A and 10B are cross-sectional views showing positioning holes in a side wall section for forming a convex-shaped section at respectively different positions of the side wall section of the convex-shaped section.
Figure 10B:
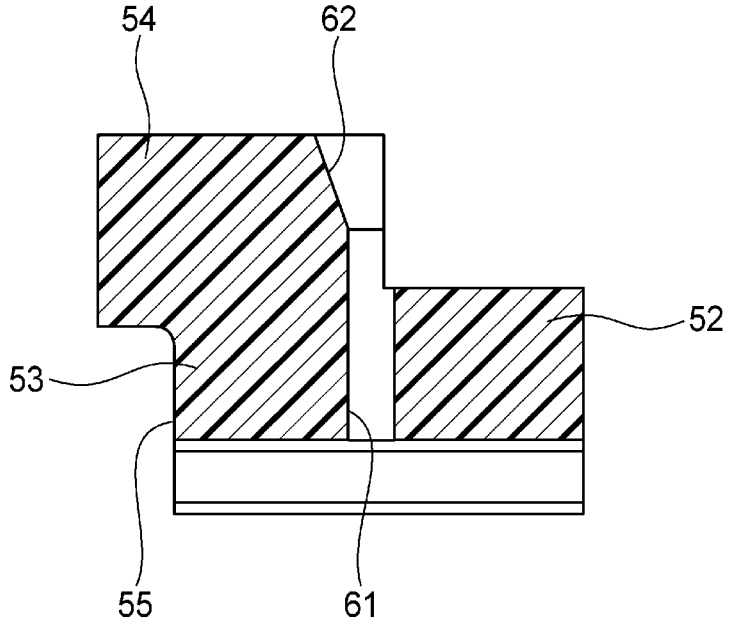
Figure 11:
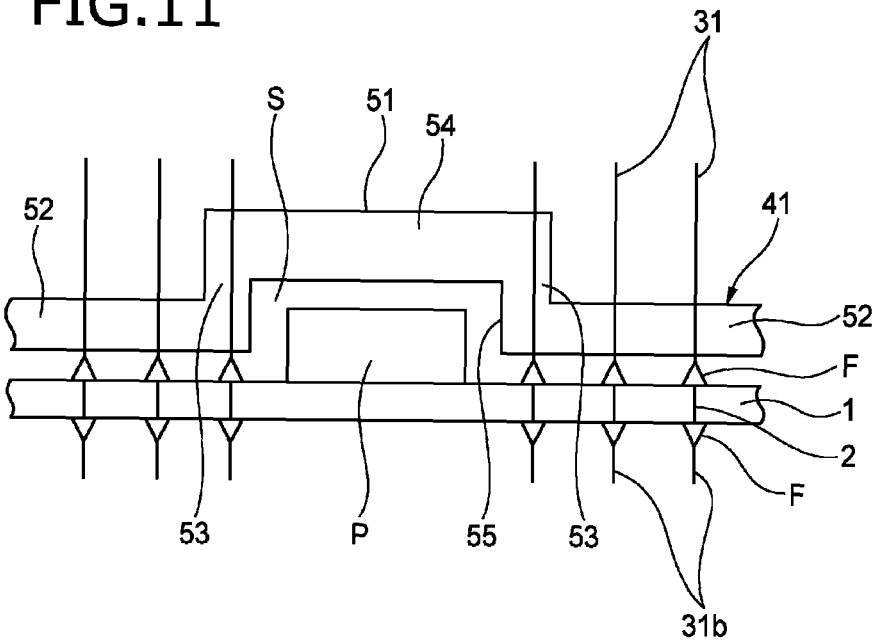
FIG. 11 is a schematic cross-sectional view showing the arrangement of a circuit board and the aligning plate in a state in which the connector is mounted on the circuit board.

FIG. 5 is a perspective view showing the aligning plate constituting the connector. FIG. 6 is a plan view showing the aligning plate constituting the connector. FIG. 7 is a side view showing the aligning plate constituting the connector. FIG. 8 is a cross-sectional view taken on line A-A of FIG. 6. FIG. 9 is an enlarged view of portion B of FIG. 6. FIGS. 10A and 10B are cross-sectional views showing positioning holes in a side wall section for forming a convex section at respectively different positions of the side wall section of the convex-shaped section. FIG. 11 is a schematic cross-sectional view showing the arrangement of the circuit board and the aligning plate in a state in which the connector is mounted on the circuit board.

As shown in FIGS. 5 to 7, press-fitting convex sections 40 are formed on one side face of the aligning plate 41 in the vicinity of both ends thereof. The side of the aligning plate 41 on which the press-fitting convex sections 40 are formed is directed to the housing 21, and both ends thereof are pushed to the plate fixing faces 27 of the housing 21, whereby the press-fitting convex sections 40 are press-fitted into the fitting concave sections formed on the plate fixing faces 27, and the aligning plate 41 is assembled at the predetermined positions of the housing 21 in this state.

The aligning plate 41 has a convex-shaped section 51 protruding to the mounting side of the housing 21 at the central portion thereof in the longitudinal direction. In other words, the aligning plate 41 has a stepped shape including a plurality of faces (the upper face of the convex-shaped portion and the upper faces of the portions other than the convex-shaped portion) being different in position in the mounting direction (the up-down direction in FIG. 5) toward the circuit board on a side face (the upper face in FIG. 5, a first face) on the opposite side of the side face (the lower face in FIG. 5) on the mounting side that is opposed to the circuit board during mounting onto the circuit board.

Both sides of the convex-shaped section 51 are used as positioning sections 52. The convex-shaped section 51 is formed into a concave-convex shape having side wall sections 53 protruding toward the housing 21 and an upper wall section 54 for connecting the end sections of the side wall sections 53 on the side of the housing 21. By the formation of the convex-shaped section 51 on the aligning plate 41, a concave section 55 (a relief section) serving as a relief section for avoiding interference with a mounting component P on the circuit board 1 is formed on the mounting side (the second face) of the aligning plate 41 toward the circuit board 1. When the housing 21 is attached to the aligning plate 41, the convex-shaped section 51 is disposed in the gap G formed between the terminal groups 32.

As shown in FIGS. 8 and 9, the aligning plate 41 is provided with a plurality of positioning holes 61 formed so as to pass through the front and back sides thereof. The positioning holes 61 are arranged in the front-rear and left-right directions (the depth direction and the width direction) of the housing 21, and the mounting terminal sections 31*b* of the terminals 31 fixed to the housing 21 are inserted into the holes. The arrangement of the positioning holes 61 is the same as that of the through holes 2 formed in the circuit board 1. With this configuration, when the mounting terminal sections 31*b* of the terminals 31 are inserted into the positioning holes 61 of the aligning plate 41, the mounting terminal sections 31*b* are positioned in the same arrangement as that of the through holes 2 of the circuit board 1.

Guide sections 62 gradually narrowing forward in the insertion direction of the mounting terminal section 31*b* of the terminal 31 are formed on one edge section of the positioning hole 61 into which the mounting terminal section 31*b* of the terminal 31 is inserted. When the mounting terminal section 31*b* of the terminal 31 to be inserted into the positioning hole 61 makes contact with the guide sections 62, the guide sections 62 guide the mounting terminal section 31*b* of the terminal 31 to the center of the positioning hole 61. As a result, the mounting terminal section 31*b* of the terminal 31 is guided to the positioning hole 61.

The positioning holes 61 are formed in almost the entire region of the positioning section 52 except for both ends thereof. Furthermore, as shown in FIG. 10A, the positioning holes 61 are also formed in the side wall sections 53 for forming the convex-shaped section 51 of the aligning plate 41. Moreover, as shown in FIG. 10B, the positioning holes 61 are also formed in the stepped portion at the boundary between the convex-shaped section 51 and the positioning section 52 of the aligning plate 41.

In order that the aligning plate 41 is assembled with the housing 21, the press-fitting convex sections 40 of the aligning plate 41 are brought close to the housing 21, and the mounting terminal sections 31*b* of the terminals 31 are inserted into the positioning holes 61 of the aligning plate 41. The press-fitting convex sections 40 of the aligning plate 41 are then press-fitted into the fitting concave sections of the plate fixing faces 27 of the housing 21. Hence, the aligning plate 41 is positioned with respect to the housing 21 and fixed to the plate fixing faces 27. In addition, when the aligning plate 41 is assembled with the housing 21, the mounting terminal sections 31*b* of the terminals 31 inserted into the positioning holes 61 of the aligning plate 41 are positioned, and the tip end sections thereof are protruded from the aligning plate 41.

When the aligning plate 41 is assembled with the housing 21 as described above, the mounting terminal sections 31*b* of the terminals 31 are positioned by the positioning holes 61. Hence, when the mounting terminal sections 31*b* of the terminals 31 are inserted into the positioning holes 61, the tilt thereof is corrected, whereby the mounting terminal sections 31*b* are arranged accurately so as to have the same arrangement as that of the through holes 2 of the circuit board 1.

Still further, with the connector 11A in which the mounting terminal sections 31*b* of the terminals 31 are arranged accurately by the aligning plate 41, the mounting terminal sections 31*b* of the terminals 31 can be inserted smoothly into the through holes 2 of the circuit board 1.

As shown in FIG. 11, when the mounting terminal sections 31*b* of the terminals 31 positioned by the aligning plate 41 are inserted into the through holes 2 and soldered, a mounting space S is formed in the concave section 55 of the convex-shaped section 51 between the aligning plate 41 of the connector 11A and the circuit board 1. Hence, the mounting component P can be mounted onto the circuit board 1 so as to be disposed in the mounting space S. When the connector 11A is mounted on the circuit board 1, the aligning plate 41 is assembled with the housing 21 at a height position not interfering with solder fillet sections F in which solder for joining the terminals 31 to the conductor patterns of the circuit board 1 rises from the surface of the circuit board 1.

The housings of mating connectors are fitted into the respective hood sections 23 of the housing 21 of the connector 11A in which the mounting terminal sections 31*b* are inserted into the through holes 2 of the circuit board 1 and soldered to the conductor patterns of the circuit board 1, whereby the mating connectors are joined to the respective joint sections 12. As a result, the connection terminal sections 31*a* of the terminals 31 of the connector 11A are connected to the female terminals of the mating connectors, whereby the female terminals of the mating connectors are conducted to the conductor patterns of the circuit board 1.

As described above, with the connector 11A according to the first embodiment, the aligning plate 41 having the plurality of positioning holes 61 and thereby being apt to be low in strength and to be warped during molding can be enhanced in strength by forming the convex-shaped section 51 and can be suppressed from being warped during molding. Hence, when the mounting terminal sections 31*b* of the terminals 31 are inserted into the positioning holes 61 of the aligning plate 41, the mounting terminal sections 31*b* of the terminals 31 are positioned and arranged accurately.

Also in the case of a connector equipped with a planar aligning plate 41 not having the convex-shaped section 51, the interference between the mounting component P and the aligning plate 41 can be avoided by placing the aligning plate 41 at a high position and by increasing the distance between the aligning plate 41 and the circuit board 1.

However, in the case that the aligning plate 41 is placed at such a high position, the lengths of the mounting terminal sections 31*b* of the terminals 31 protruding from the positioning holes 61 of the aligning plate 41 become long, and the positioning accuracy of the terminals 31 is degraded. In particular, in a structure equipped with multistage terminals 31 having connection terminal sections 31*a* being bent and extending sideward, when the aligning plate 41 is placed at the high position, it is difficult to insert the terminals 31 having the connection terminal sections 31*a* disposed at the lowest stage into the positioning holes 61 of the aligning plate 41. Furthermore, even if the aligning plate 41 is placed at the high position, in order that the terminals 31 having the connection terminal sections 31*a* disposed at the lowest stage can be inserted into the positioning holes 61 of the aligning plate 41, the mounting terminal sections 31*b* of the terminals 31 are required to be made long, whereby the connector cannot be made low in profile.

On the other hand, in the case of the connector 11A according to the first embodiment, since the aligning plate 41 is provided with the convex-shaped section 51 protruding to the opposite side of the mounting side toward the circuit board 1 and having the concave section 55 on the mounting side toward the circuit board 1, when the aligning plate 41 is mounted on the circuit board 1, the mounting space S is formed between the concave section 55 of the convex-shaped section 51 of the aligning plate 41 and the circuit board 1. Hence, the mounting component P can be mounted onto the circuit board 1 so as to be disposed in the mounting space S. In other words, the mounting density on the circuit board 1 can be enhanced, and the terminals 31 can be positioned properly while the interference between the mounting component P and the aligning plate 41 is avoided and the connector is made low in profile.

In addition, in the region of the aligning plate 41 opposed to the arrangement position of the mounting component P on the circuit board 1, the interference between the aligning plate 41 and the mounting component P can be prevented, and in regions other than the region opposed to the arrangement position of the mounting component P on the circuit board 1, the interference between the aligning plate 41 and the solder fillet sections F on the through holes 2 can be prevented while the height of the connector is suppressed.

Furthermore, since the positioning holes 61 are also formed in the side wall sections 53 for forming the convex-shaped section 51, the region for positioning the terminals 31 using the positioning holes 61 in the aligning plate 41 can be securely obtained as large as possible. Hence, the aligning plate 41 provided with the convex-shaped section 51 can be suppressed from being enlarged. In particular, even in the case that the through holes 2 are formed in the vicinity of the mounting component P mounted in the mounting space S between the concave section 55 of the convex-shaped section 51 and the circuit board 1, the interference between the mounting component P and the aligning plate 41 can be avoided, and the mounting terminal sections 31*b* of the terminals 31 can be inserted into the through holes 2 formed in the vicinity of the mounting component P.

Moreover, since the convex-shaped section 51 is formed in the gap G between the terminal groups 32 in which the terminals 31 are not required to be positioned, the strength of the aligning plate 41 can be enhanced and the mounting density on the circuit board 1 can be improved while the space is utilized effectively.

Second Embodiment

Next, a connector according to a second embodiment will be described referring to FIG. 12. The same components as those according to the first embodiment are designated by the same numerals and their descriptions are omitted (the same applies to other embodiments to be described below).

The connector according to the second embodiment differs from the connector according to the first embodiment mainly in the aligning plate. Hence, the aligning plate 41 of the connector according to the second embodiment will be mainly described below. For convenience of explanation, the face (first face) of the aligning plate 41 on the opposite side of the mounting side toward the circuit board 1 is referred to as an "upper face" and the face (the second face) of the aligning plate 41 on the mounting side toward the circuit board 1 is referred to as a "lower face" (the same applies to other embodiments to be described below).

Figure 12:
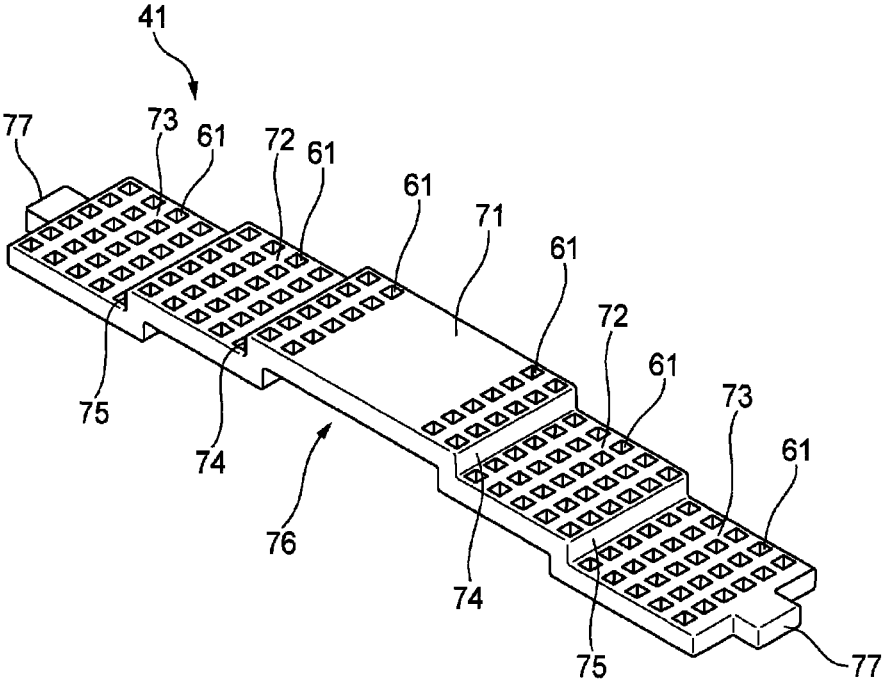
FIG. 12 is a perspective view showing the aligning plate of a connector according to a second embodiment.

As shown in FIG. 12, the aligning plate 41 according to the second embodiment is formed into a narrow plate shape, both ends thereof in the width direction being supported by the housing 21. The aligning plate 41 has a plurality of faces having three steps being different in height and parallel to one another on the upper face. More specifically, an upper step face 71 serving as the uppermost step is provided at the central section in the width direction, a pair of intermediate step faces 72 serving as intermediate steps is provided outside the upper step face 71 in the width direction, and a pair of lower step faces 73 serving as the lowermost steps is provided outside the pair of intermediate step faces 72 in the width direction. A pair of step sections 74 for connecting the upper step face 71 to the intermediate step faces 72 is formed in the depth direction, and a pair of step sections 75 for connecting the intermediate step faces 72 to the lower step faces 73 is also formed in the depth direction. In other words, the faces of the aligning plate 41 being different in position in the mounting direction are arranged in the width direction of the aligning plate 41, whereby a stepped shape is formed.

The thickness values of the portions respectively corresponding to the upper step face 71, the intermediate step face 72 and the lower step face 73 of the aligning plate 41 are almost equal. In other words, on the lower face of the aligning plate 41, a concave section 76 having a plurality of steps is formed so as to follow the convex shape having the plurality of steps on the upper face of the aligning plate 41. This concave section 76 can function as a "relief section" for avoiding interference with the mounting component P on the circuit board 1 during mounting onto the circuit board 1.

In this aligning plate 41, the positioning holes 61 are formed in the regions including all the faces, that is, the upper step face 71, the intermediate step faces 72 and the lower step faces 73. More specifically, the positioning holes 61 are formed only in the vicinity of both end sections of the upper step face 71 in the width direction and also formed in all the regions of the intermediate step faces 72 and the lower step faces 73.

A pair of engaging sections 77 to be engaged with the above-mentioned plate fixing faces 27 (refer to FIGS. 2 and 3) of the housing 21 is provided on both end sections of the aligning plate 41 in the width direction. In the case that the aligning plate 41 is engaged with the housing 21, the aligning plate 41 is not necessarily required to be engaged at both ends (the engaging sections 77) but may be engaged at other positions (refer to the arrangement of through holes 41*a* described later and shown in FIGS. 29A to 29C).

With the aligning plate 41 according to the second embodiment, the aligning plate 41 having the plurality of positioning holes 61 and thereby being apt to be low in strength and to be warped during molding can be enhanced in strength by providing the step sections 74 and 75 along the depth direction on the upper face and can be suppressed from being warped during molding. Furthermore, the concave section 76 provided on the lower face thereof can be used to function as a "relief section" for avoiding interference with the mounting component P on the circuit board 1 during mounting onto the circuit board 1.

Moreover, the positioning holes 61 of the aligning plate 41 are formed in the regions on the upper face including the plurality of faces (the upper step face 71, the intermediate step faces 72 and the lower step faces 73) being different in height. Hence, in a state in which the upper face of the aligning plate 41 is directed toward the terminals 31, when the terminals 31 are inserted into the positioning holes 61 of the aligning plate 41, the terminals 31 are inserted sequentially, step by step, from the terminals 31 located at the position corresponding to the uppermost step (the upper step face 71) to the terminals 31 located at the position corresponding to the lowermost steps (the lower step faces 73). Hence, the number of the terminals 31 to be inserted at a time is less than the number in a configuration in which the upper face has no step (in other words, all the terminals are inserted into the positioning holes 61 at a time). What's more, when some of the terminals 31 have been inserted into the positioning holes 61, the remaining terminals 31 are apt to be disposed in the vicinity of the positions corresponding to the positioning holes 61 into which the terminals 31 are supposed to be inserted subsequently. For this reason, the insertion operation of the terminals 31 into the aligning plate 41 is made easy and the assembly time can be shortened.

Although the aligning plate 41 has the plurality of faces having three steps being different in height and parallel to one another in the second embodiment, the aligning plate 41 may have a plurality of faces being different in height in two or four or more steps and parallel to one another. In addition, the number of the terminals 31 to be inserted into the positioning holes 61 at a time can be changed arbitrarily for each step by changing the number of the positioning holes 61 provided for each step.

Third Embodiment

Next, a connector according to a third embodiment will be described referring to FIGS. 13 and 14. The connector according to the third embodiment differs from the connector according to the first embodiment mainly in the aligning plate. The aligning plate 41 of the connector according to the third embodiment will be mainly described below. FIG. 14 is a side view showing the aligning plate 41 shown in FIG. 13 as viewed from the right lower side of the figure.

Figure 13:
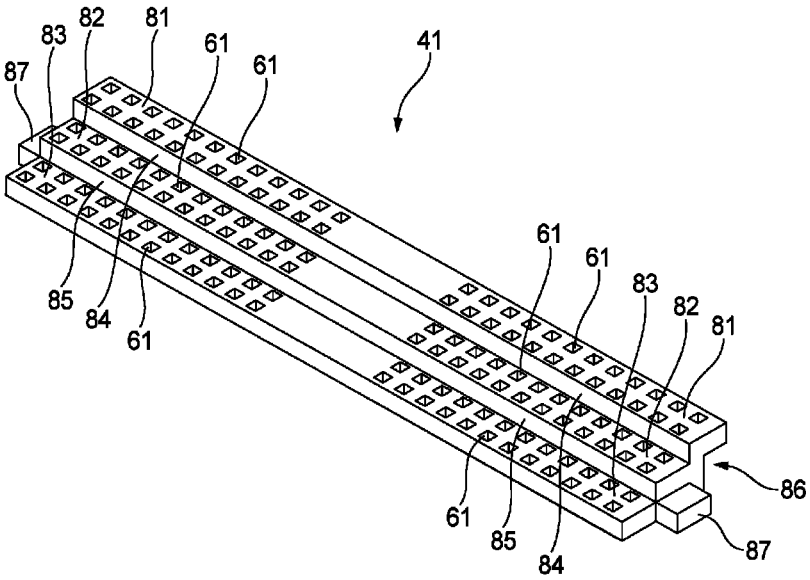
FIG. 13 is a perspective view showing the aligning plate of a connector according to a third embodiment.
Figure 14:
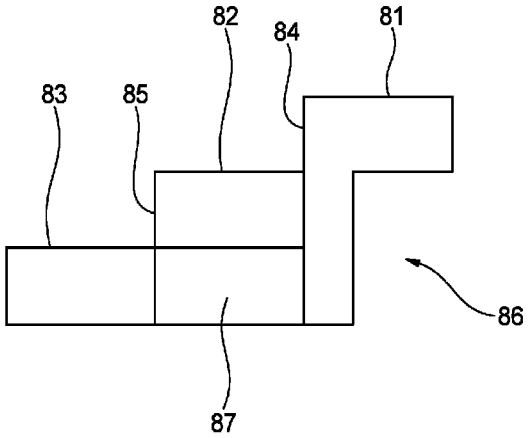
FIG. 14 is a side view showing the aligning plate shown in FIG. 13.

As shown in FIGS. 13 and 14, the aligning plate 41 according to the third embodiment is formed into a narrow plate shape, both ends thereof in the width direction being supported by the housing 21. The aligning plate 41 has a plurality of faces having three steps being different in height and parallel to one another on the upper face. More specifically, an upper step face 81 serving as the uppermost step is provided on the deepest side in the depth direction, an intermediate step face 82 serving as an intermediate step is provided on the front side of the upper step face 81, and a lower step face 83 serving as the lowermost step is provided on the front side of the intermediate step face 82. A step section 84 for connecting the upper step face 81 to the intermediate step face 82 and a step section 85 for connecting the intermediate step face 82 to the lower step face 83 are formed in the width direction. In other words, the faces being different in position in the mounting direction of the aligning plate 41 are arranged in the depth direction orthogonal to the width direction of the aligning plate 41, whereby a stepped shape is formed.

As understood referring to FIG. 14, the thickness values of the portions respectively corresponding to the upper step face 81 and the lower step face 83 are almost equal, and the thickness value of the portion corresponding to the intermediate step face 82 is larger (approximately two times) than those of the portions corresponding to the upper step face 81 and the lower step face 83. As a result, on the lower face of the aligning plate 41, a concave section 86 is formed at the portion corresponding to the upper step face 81 as viewed from above. This concave section 86 can function as a "relief section" for avoiding interference with the mounting component P on the circuit board 1 during mounting onto the circuit board 1.

On the upper face of this aligning plate 41, the positioning holes 61 are formed in the regions including all the faces, that is, the upper step face 81, the intermediate step face 82 and the lower step face 83. More specifically, the positioning holes 61 are formed in all the regions of the step faces except for their central sections in the width direction as viewed from above.

A pair of engaging sections 87 to be engaged with the above-mentioned plate fixing faces 27 (refer to FIGS. 2 and 3) of the housing 21 is provided on both end sections of the aligning plate 41 in the width direction. Although the pair of engaging sections 87 is formed on the side walls of the portions corresponding to the intermediate step face 82 in this embodiment as shown in FIG. 14, the engaging sections 87 may be formed on the side walls of the portions corresponding to the lower step face 83. The aligning plate 41, however, is not necessarily required to be engaged at both ends (the engaging sections 87) but may be engaged at other positions (refer to the arrangement of through holes 41*a* described later and shown in FIGS. 29A to 29C).

With the aligning plate 41 according to the third embodiment, the aligning plate 41 having the plurality of positioning holes 61 and thereby being apt to be low in strength and to be warped during molding can be enhanced in strength by providing the step sections 84 and 85 along the width direction on the upper face and can be suppressed from being warped during molding. Furthermore, the concave section 86 provided on the lower face thereof can be used to function as a "relief section" for avoiding interference with the mounting component P on the circuit board 1 during mounting onto the circuit board 1.

Moreover, the positioning holes 61 of the aligning plate 41 are formed in the regions on the upper face including the plurality of faces (the upper step face 81, the intermediate step face 82 and the lower step face 83) being different in height. Hence, in a state in which the upper face of the aligning plate 41 is directed toward the terminals 31, when the terminals 31 are inserted into the positioning holes 61 of the aligning plate 41, the terminals 31 are inserted sequentially, step by step, from the terminals 31 located at the position corresponding to the uppermost step (the upper step face 81) to the terminals 31 located at the position corresponding to the lowermost step (the lower step face 83). Hence, the number of the terminals 31 to be inserted at a time is less than the number in a configuration in which the upper face has no step (in other words, all the terminals are inserted at a time). What's more, when some of the terminals 31 have been inserted into the positioning holes 61, the remaining terminals 31 are apt to be disposed in the vicinity of the positions corresponding to the positioning holes 61 into which the terminals 31 are supposed to be inserted subsequently. For this reason, the insertion operation of the terminals 31 into the aligning plate 41 is made easy and the assembly time can be shortened.

Modification of the Third Embodiment

Figure 15:
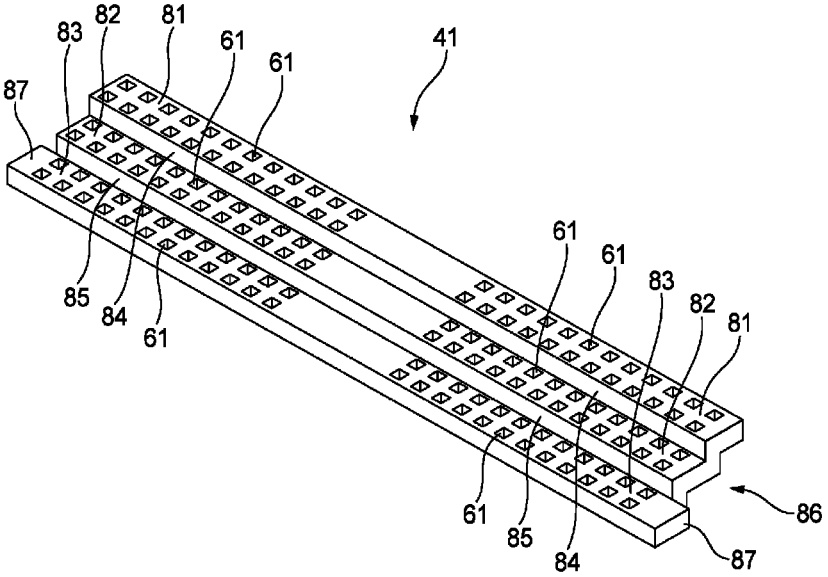
FIG. 15 is a perspective view showing the aligning plate of a connector according to a first modification of the third embodiment.
Figure 16:
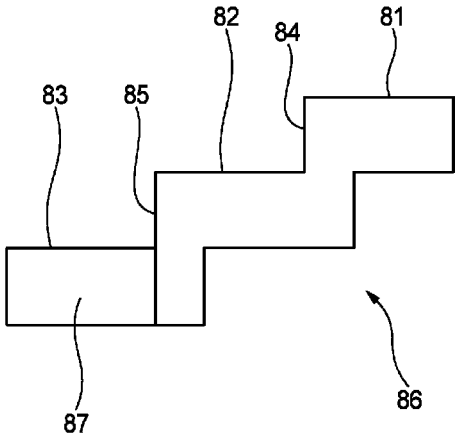
FIG. 16 is a side view showing the aligning plate shown in FIG. 15.

FIGS. 15 and 16 show an aligning plate 41 according to a first modification of the third embodiment. FIG. 16 is a side view showing the aligning plate 41 shown in FIG. 15 as viewed from the right lower side of the figure.

As shown in FIGS. 15 and 16, in the aligning plate 41, the thickness value of the portion corresponding to the intermediate step face 82 is almost equal to those of the upper step face 81 and the lower step face 83; in this respect, the aligning plate 41 differs from that according to the third embodiment (the thickness value of the portion corresponding to the intermediate step face 82 is approximately two times as large as those of the upper step face 81 and the lower step face 83).

Because of this difference, on the lower face of the aligning plate 41, a continuously concave section 86 is formed at the portions corresponding to the upper step face 81 and the intermediate step face 82 as viewed from above. In other words, the capacity of the concave section 86 is larger than that in the third embodiment. This concave section 86 can function as a "relief section" for avoiding interference with the mounting component P on the circuit board 1 during mounting onto the circuit board 1.

Figure 17:
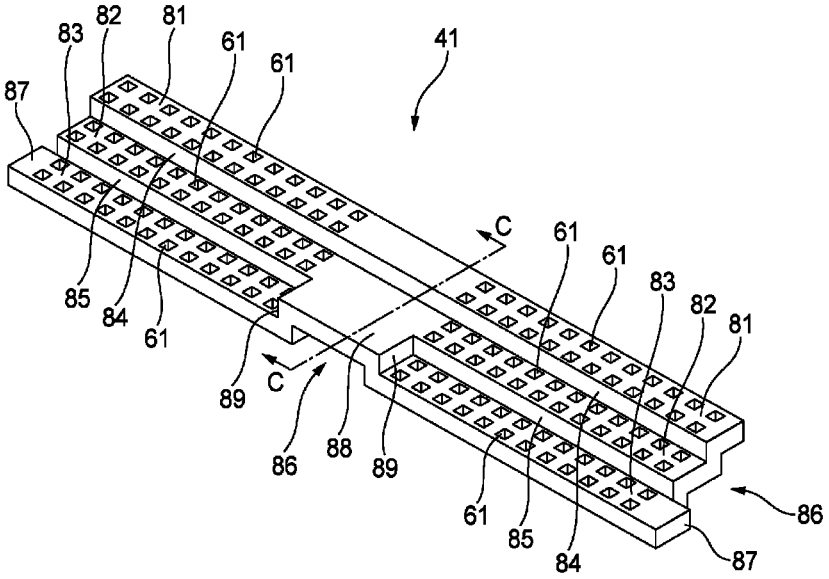
FIG. 17 is a perspective view showing the aligning plate of a connector according to a second modification of the third embodiment.
Figure 18:
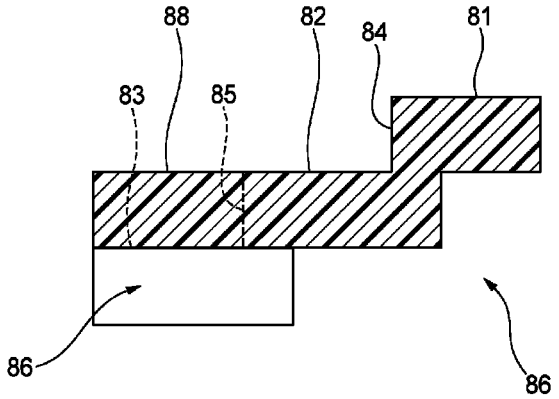
FIG. 18 is a cross-sectional view taken on line C-C of FIG. 17.

FIGS. 17 and 18 show an aligning plate 41 according to a second modification of the third embodiment. FIG. 18 is a cross-sectional view taken on line C-C of FIG. 17.

As shown in FIGS. 17 and 18, in this aligning plate 41, a fourth face 88 positioned above the lower step face 83 at the central section of the lower step face 83 in the width direction is formed (in this modification, the height of the fourth face 88 is almost equal to that of the intermediate step face 82), and only in this respect, this modification differs from the first modification of the third embodiment in which such a fourth face is not formed. A pair of step sections 89 extending in the depth direction is formed at both ends of the fourth face 88 in the width direction.

In this aligning plate 41, the thickness value of the portion corresponding to the fourth face 88 is almost equal to that of the lower step face 83. As a result, on the lower face of the aligning plate 41, a continuously concave section 86 is formed at the portions corresponding to the upper step face 81, the intermediate step face 82 and the fourth face 88 as viewed from above. In other words, the capacity of the concave section 86 is larger than that in the first modification of the third embodiment. This concave section 86 can function as a "relief section" for avoiding interference with the mounting component P on the circuit board 1 during mounting onto the circuit board 1.

Figure 19:
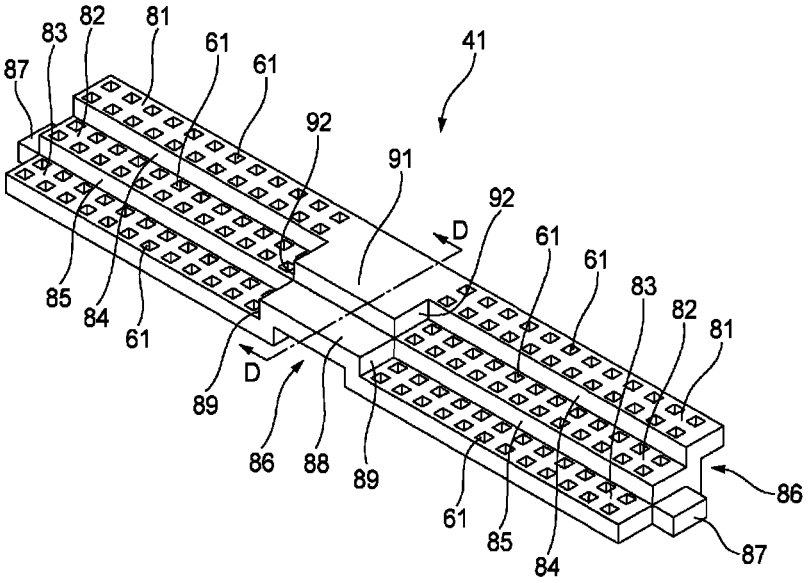
FIG. 19 is a perspective view showing the aligning plate of a connector according to a third modification of the third embodiment.
Figure 20:
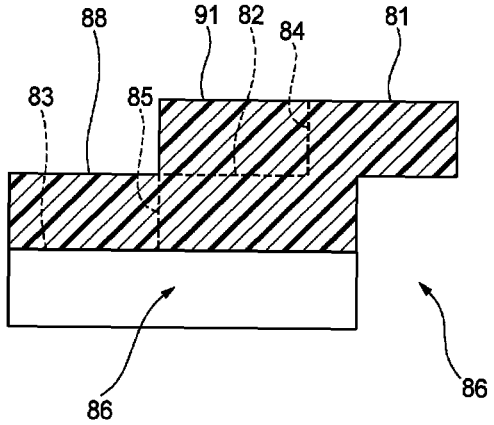
FIG. 20 is a cross-sectional view taken on line D-D of FIG. 19.

FIGS. 19 and 20 show an aligning plate 41 according to a third modification of the third embodiment. FIG. 20 is a cross-sectional view taken on line D-D of FIG. 19.

As shown in FIGS. 19 and 20, in this aligning plate 41, a fourth face 88 positioned above the lower step face 83 at the central section of the lower step face 83 in the width direction is formed (the height of the fourth face 88 is almost equal to that of the intermediate step face 82) and a fifth face 91 positioned above the intermediate step face 82 at the central section of the intermediate step face 82 in the width direction is formed (the height of the fifth face 91 is almost equal to that of the upper step face 81), and only in this respect, this modification differs from the third embodiment in which such fourth and fifth faces are not formed. A pair of step sections 89 extending in the depth direction is formed at both ends of the fourth face 88 in the width direction, and a pair of step sections 92 extending in the depth direction is formed at both ends of the fifth face 91 in the width direction.

In this aligning plate 41, the thickness value of the portion corresponding to the fourth face 88 is almost equal to that of the lower step face 83, and the thickness value of the portion corresponding to the fifth face 91 is almost equal to that of the intermediate step face 82. As a result, on the lower face of the aligning plate 41, a continuously concave section 86 is formed at the portions corresponding to the upper step face 81, the fourth face 88 and the fifth face 91 as viewed from above. In other words, the capacity of the concave section 86 is larger than that in the third embodiment. This concave section 86 can function as a "relief section" for avoiding interference with the mounting component P on the circuit board 1 during mounting onto the circuit board 1.

Reference Example of the Third Embodiment

Figure 21:
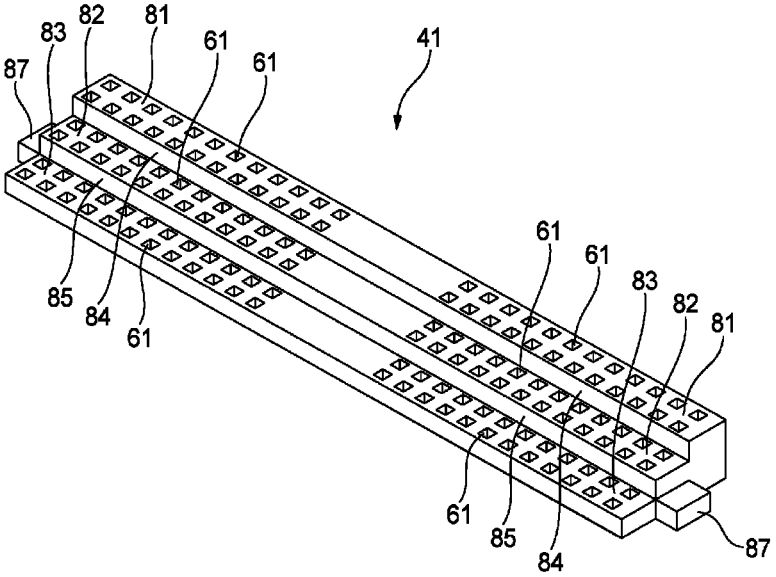
FIG. 21 is a perspective view showing the aligning plate of a connector according to a reference example (a first reference example) of the third embodiment.
Figure 22:
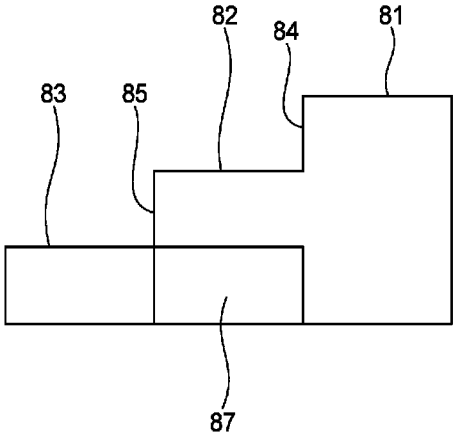
FIG. 22 is a side view showing the aligning plate shown in FIG. 21.

FIGS. 21 and 22 show an aligning plate 41 according to a reference example (a first reference example) of the third embodiment. FIG. 22 is a side view showing the aligning plate 41 shown in FIG. 21 as viewed from the right lower side of the figure.

As shown in FIGS. 21 and 22, in the aligning plate 41, the thickness value of the portion corresponding to the upper step face 81 is larger (approximately three times) than that of the portion corresponding to the lower step face 83, and only in this respect, this reference example differs from the third embodiment in which the thickness value of the portion corresponding to the upper step face 81 is almost equal to that of the lower step face 83.

Because of this difference, the lower face of the aligning plate 41 is flat over the whole region, and as a result, no concave section is formed. In other words, a portion capable of functioning as a "relief section" for avoiding interference with the mounting component P on the circuit board 1 during mounting onto the circuit board 1 does not exist.

In the third embodiment and the modifications thereof, although the aligning plate 41 has a plurality of faces having three steps being different in height and parallel to one another on the upper face, the aligning plate 41 may have a plurality of faces being different in height in two or four or more steps and parallel to one another. Furthermore, the number of the terminals 31 to be inserted into the positioning holes 61 at a time can be changed arbitrarily for each step by changing the number of the positioning holes 61 provided for each step.

Fourth Embodiment

Next, a connector according to a fourth embodiment will be described referring to FIGS. 23 to 27. The connector according to the fourth embodiment differs from the connector according to the first embodiment mainly in the aligning plate. The aligning plate 41 of the connector according to the fourth embodiment will be mainly described below. FIG. 24 is a cross-sectional view taken on line E-E of FIG. 23, and FIG. 25 is a cross-sectional view taken on line F-F of FIG. 23.

Figure 23:
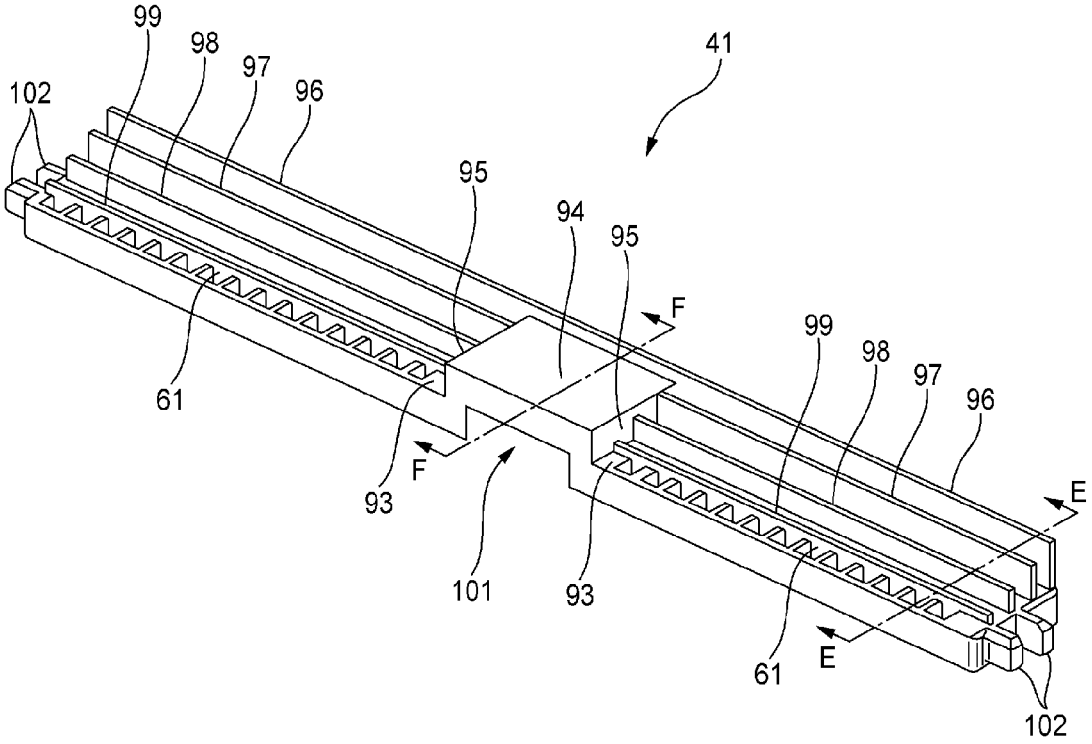
FIG. 23 is a perspective view showing the aligning plate of a connector according to a fourth embodiment.
Figure 24:
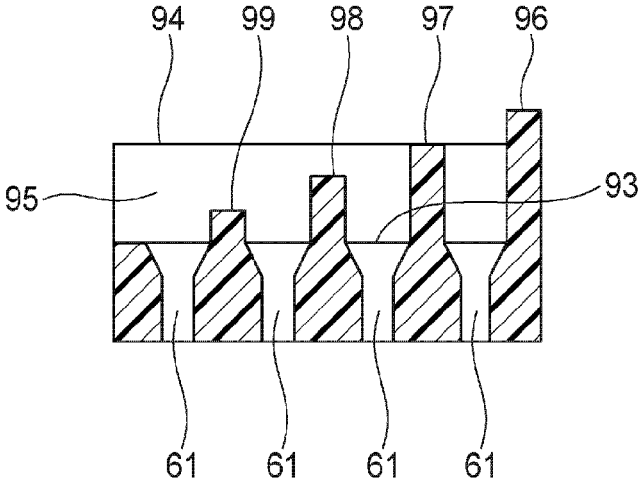
FIG. 24 is a cross-sectional view taken on line E-E of FIG. 23.
Figure 25:
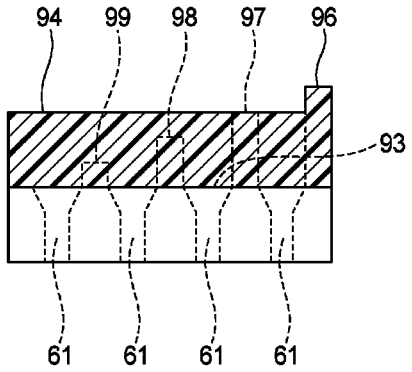
FIG. 25 is a cross-sectional view taken on line F-F of FIG. 23.

As shown in FIGS. 23 to 25, the aligning plate 41 according to the fourth embodiment is formed into a narrow plate shape, both ends thereof in the width direction being supported by the housing 21. On the upper face of the aligning plate 41, an upper step face 94 positioned above a flat lower step face 93 at the central section of the lower step face 93 in the width direction is formed. A pair of step sections 95 is formed at both ends of the upper step face 94 in the width direction. In other words, the aligning plate 41 has a stepped shape including a plurality of faces (the upper face of the convex-shaped portion and the upper faces of the portions other than the convex-shaped portion) being different in position in the mounting direction (the up-down direction in FIG. 23) toward the circuit board on a side face (the upper face in FIG. 23, a first face) on the opposite side of the side face (the lower face in FIG. 23) on the mounting side that is opposed to the circuit board during mounting onto the circuit board.

The thickness value of the portion corresponding to the upper step face 94 is almost equal to that of the portion corresponding to the lower step face 93. As a result, on the lower face (the second face) of the aligning plate 41, a concave section 101 is formed at the portion corresponding to the upper step face 94 as viewed from above. This concave section 101 can function as a "relief section" for avoiding interference with the mounting component P on the circuit board 1 during mounting onto the circuit board 1.

This aligning plate 41 is provided with a plurality of positioning holes 61 at a plurality of respective positions (four positions in this embodiment) in the depth direction so as to be parallel in the width direction. Furthermore, on the upper face of the aligning plate 41, at the plurality of respective positions in the depth direction, wall sections 96 to 99, protruding upward continuously from the respective openings of the plurality of positioning holes 61 arranged in the width direction and extending in the width direction, are formed sequentially from the depth side to the front side in the depth direction. In other words, the positioning holes 61 are arranged along the wall sections 96 to 99 in the width direction of the aligning plate 41. Moreover, the protruding heights of the wall sections 96 to 99 are high in order of the wall sections 96, 97, 98 and 99.

A pair of engaging sections 102 to be engaged with the above-mentioned plate fixing faces 27 (refer to FIGS. 2 and 3) of the housing 21 is provided on each of both end sections of the aligning plate 41 in the width direction. The aligning plate 41 is not necessarily required to be engaged at both ends (the engaging sections 102) but may be engaged at other positions (refer to the arrangement of through holes 41*a* to be described later and shown in FIGS. 29A to 29C).

With the aligning plate 41 according to the fourth embodiment, the aligning plate 41 having the plurality of positioning holes 61 and thereby being apt to be low in strength and to be warped during molding can be enhanced in strength by providing the step sections 95 along the depth direction on the upper face and can be suppressed from being warped during molding. Furthermore, the concave section 101 provided on the lower face thereof can be used to function as a "relief section" for avoiding interference with the mounting component P on the circuit board 1 during mounting onto the circuit board 1.

Figure 26:
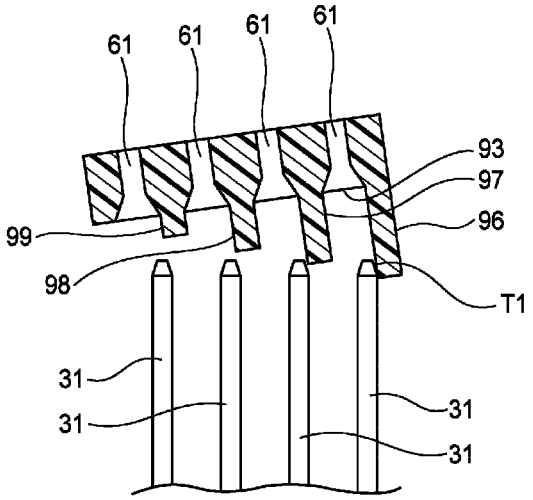
FIG. 26 is a first view illustrating the work for assembling the aligning plate shown in FIG. 23 with terminals.
Figure 27:
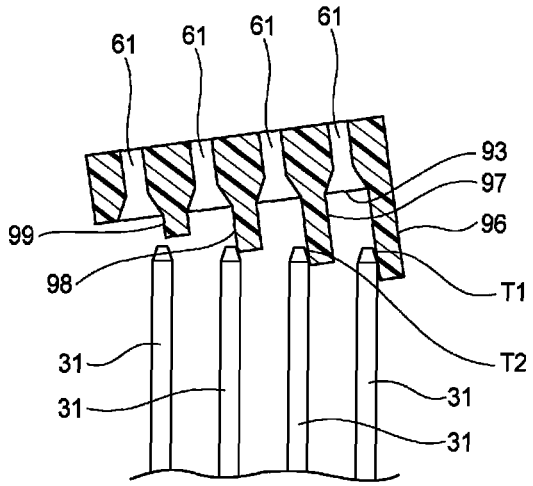
FIG. 27 is a second view illustrating the work for assembling the aligning plate shown in FIG. 23 with the terminals.

Furthermore, as shown in FIGS. 26 and 27, in a state in which the upper face of the aligning plate 41 is directed toward the terminals 31, when the terminals 31 are inserted into the positioning holes 61 of the aligning plate 41, the terminals 31 can be inserted at a time while being slid toward the positioning holes 61 along the side faces of the wall sections 96 to 99 while the aligning plate 41 is maintained in a state of being tilted obliquely.

More specifically, as shown in FIG. 26, first, the tip ends of the plurality of terminals 31 arranged in the width direction and corresponding to the wall section 96 having the highest protruding height collide with the side faces of the wall section 96 and are held thereby (see point T1 in FIG. 26). Then, when the aligning plate 41 is brought closer to the terminals 31 while the tip ends of the plurality of terminals 31 are in contact with the side faces of the wall section 96 as described above, as shown in FIG. 27, the tip ends of the plurality of terminals 31 arranged in the width direction and corresponding to the wall section 97 adjacent to the wall section 96 collide with the side faces of the wall section 97 and are held thereby (see points T1 and T2 in FIG. 27).

This operation for holding the tip ends of the terminals 31 at each wall section is also performed by the wall sections 98 and 99 sequentially. When the operations for holding the tip ends of the terminals 31 at all the wall sections 96 to 99 are completed, all the terminals 31 are then inserted into the positioning holes 61 at a time while being slid toward the positioning holes 61 along the respective side faces of the wall sections 96 to 99. For this reason, the insertion operation of the terminals 31 into the aligning plate 41 is made easy and the assembly time can be shortened.

Reference Example of the Fourth Embodiment

Figure 28:
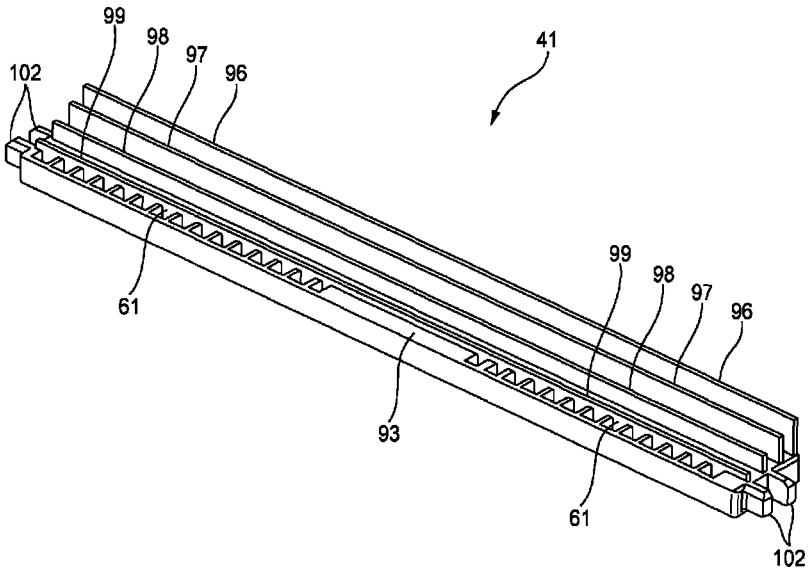
FIG. 28 is a perspective view showing the aligning plate of a connector according to a reference example (a second reference example) of the fourth embodiment.

FIG. 28 shows an aligning plate 41 according to a reference example (a second reference example) of the fourth embodiment. As shown in FIG. 28, this aligning plate 41 differs from the aligning plate 41 according to the fourth embodiment in which the upper step face 94 positioned above the flat lower step face 93 is formed only in that the upper step face 94 positioned above the flat lower step face 93 is not formed Because of this difference, the lower face of the aligning plate 41 is flat over the whole region, and as a result, no concave section is formed. In other words, a portion capable of functioning as a "relief section" for avoiding interference with the mounting component P on the circuit board 1 during mounting onto the circuit board 1 does not exist.

In the fourth embodiment, on the upper face of the aligning plate 41, the positioning holes 61 and the wall sections corresponding thereto are provided at respective three positions in the depth direction. However, the positioning holes 61 and the wall section may be provided at only one position in the depth direction, or the positioning holes 61 and the wall sections may be provided at respective four or more positions in the depth direction.

Fifth Embodiment

Figure 29A:
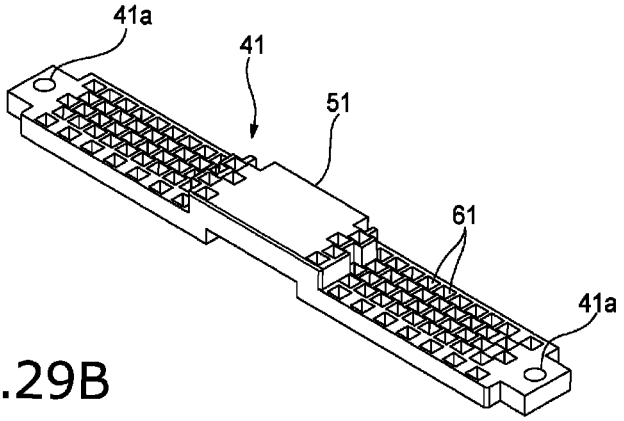
FIGS. 29A to 29C are perspective views showing examples indicating the arrangement of the through holes provided in aligning plates according to a fifth embodiment, the through holes being different in arrangement.
Figure 29B:
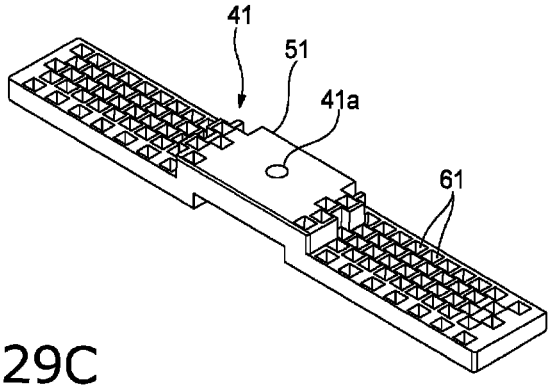
Figure 29C:
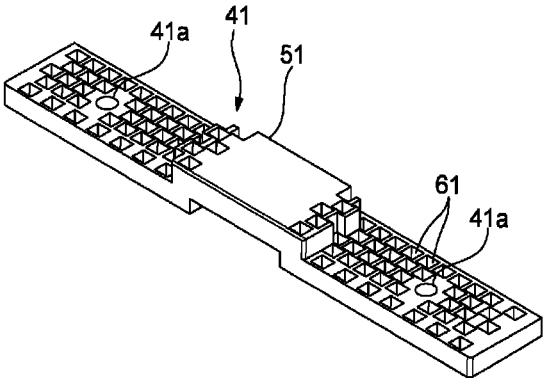

Next, a connector according to a fifth embodiment will be described referring to FIGS. 29A to 29C and FIGS. 30 and 31. The connector according to the fifth embodiment differs from the connector according to the first embodiment mainly in the engaging structure for fixing the circuit board 1, the housing 21 and the aligning plate 41. The engaging structure for fixing the aligning plate 41 of the connector according to the fifth embodiment and the circuit board 1 to the housing 21 is mainly described below. FIGS. 29A to 29C are views showing examples (three examples) indicating the positions of through holes 41*a* provided in the aligning plate 41, and FIG. 31 is an enlarged view showing the protruding section 103 of the housing 21 shown in FIG. 30.

In the engaging structure for fixing the circuit board 1, the housing 21 and the aligning plate 41, the through holes 41*a* to which the protruding sections 103 (detailed later) formed on the housing 21 are press-fitted are formed in the aligning plate 41 according to this embodiment. The positions and the number of the through holes 41*a* are not limited in particular and are determined in consideration of the shape of the housing 21, the layout of the circuit board 1 onto which the aligning plate 41 is mounted, the required strength of the fixing, etc.

For example, as shown in FIG. 29A, the through holes 41*a* may be formed at both end sections of the aligning plate 41 in the width direction. Furthermore, as shown in FIG. 29B, the through hole 41*a* may be formed in the convex-shaped section 51 (the stepped shape portion) of the aligning plate 41. Moreover, as shown in FIG. 29C, the through holes 41*a* may be formed inside the regions in which the positioning holes 61 of the aligning plate 41 are formed.

The protruding section 103 (refer to FIGS. 30 and 31) having been press-fitted into the through hole 41*a* of the aligning plate 41 reaches the circuit board 1 and is engaged with the circuit board 1 as described later. Hence, in the case that the through hole 41*a* is provided in the convex-shaped section 51 as shown in FIG. 29B, the position of the through hole 41*a* is determined so that the protruding section 103 does not interfere with the mounting component P and other parts located in the lower section (the relief section having been referred to in the first to fourth embodiments) of the convex-shaped section 51. Similarly, in the case that the through holes 41*a* are provided inside the regions in which the positioning holes 61 are formed as shown in FIG. 29C, the positions of the through holes 41*a* are determined so that the protruding sections 103 do not interfere with the pattern wiring and the like on the circuit board 1. In the case that the through holes 41*a* are provided at both end sections of the aligning plate 41 as shown in FIG. 29A, since the protruding sections 103 generally reach positions close to the end sections (peripheral sections) of the circuit board 1, the interfere of the protruding sections 103 with the mounting component P, the pattern wiring, etc. is easily avoided in comparison with the cases shown in FIGS. 29B and 29C.

Figure 30:
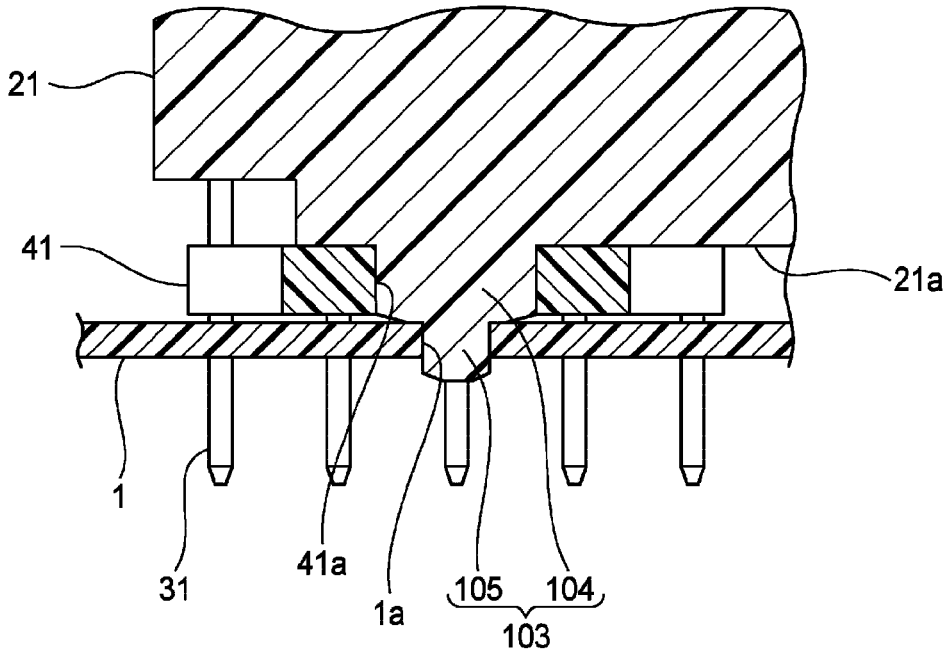
FIG. 30 is a main cross-sectional view showing an assembled state of the housing and the aligning plate of the connector with the circuit board according to the fifth embodiment.
Figure 31:
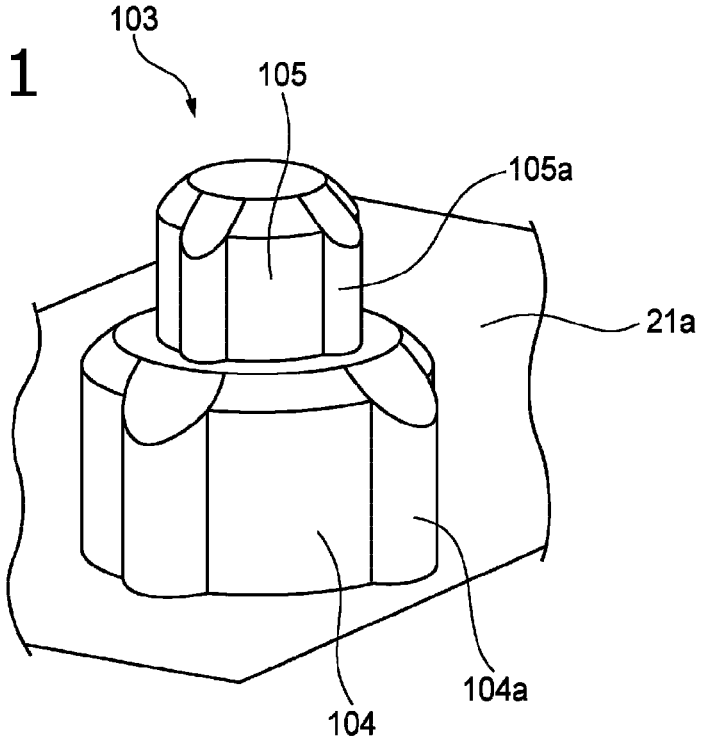
FIG. 31 is an enlarged view showing the protruding section of the housing shown in FIG. 30.

On the other hand, as shown in FIGS. 30 and 31, the protruding section 103 protruding to the mounting side (the lower side) of the aligning plate 41 toward the circuit board 1 is formed at the position of the bottom face 21*a* of the housing 21 opposed to the circuit board 1 and corresponding to the through hole 41*a*. For convenience, FIG. 30 gives a cross-sectional view showing a case in which the through holes 41*a* are provided at both end sections of the aligning plate 41 as shown in FIG. 29A.

Since the protruding section 103 passes through the corresponding through hole 41*a* of the aligning plate 41 as described above and is engaged with a corresponding mounting hole 1*a* (a through hole in this embodiment) formed in the circuit board 1, the aligning plate 41 and the circuit board 1 are fixed to the housing 21.

As shown in FIG. 31, the protruding section 103 has a first step section 104 extending from the bottom face 21*a* of the housing 21 to the mounting side (the lower side) of the aligning plate 41 toward the circuit board 1 and a second step section 105 extending from the first step section 104 to the mounting side (the lower side) of the aligning plate 41 toward the circuit board 1. The diametric size of the second step section 105 is smaller than the diametric size of the first step section 104. On the side face of the first step section 104, convex sections 104*a* protruding outward in the radial direction are formed at a plurality of positions in the circumferential direction, and on the side face of the second step section 105, convex sections 105*a* protruding outward in the radial direction are formed at a plurality of positions in the circumferential direction.

The convex sections 104*a* of the first step section 104 are press-fitted into the through hole 41*a* of the aligning plate 41, and the convex sections 105*a* of the second step section 105 are press-fitted into the through hole 1*a* of the circuit board 1, whereby the aligning plate 41 and the circuit board 1 can be fixed firmly to the housing 21.

With the engaging structure according to the fifth embodiment, the aligning plate 41 and the circuit board 1 can be fixed to the housing 21 by using the engaging structure common to the aligning plate 41 and the circuit board 1. Hence, the connector can be made compact and the cost of the connector can be reduced in comparison with a configuration in which the aligning plate 41 and the circuit board 1 are fixed to the housing 21 using separated engaging structures. Furthermore, since assembling errors can be made small, the positional displacement between the through hole of the circuit board and the terminal can be reduced, and the work for mounting the connector is made easy.

Modification of the Fifth Embodiment

Next, a connector according to a modification of the fifth embodiment will be described referring to FIGS. 32 to 34. The connector according to this modification mainly differs from the connector according to the fifth embodiment in that the protruding section 103 provided on the housing 21 is engaged with not only the aligning plate 41 and the circuit board 1 but also a waterproof case 200 (a housing) to be attached to the connector.

Figure 32:
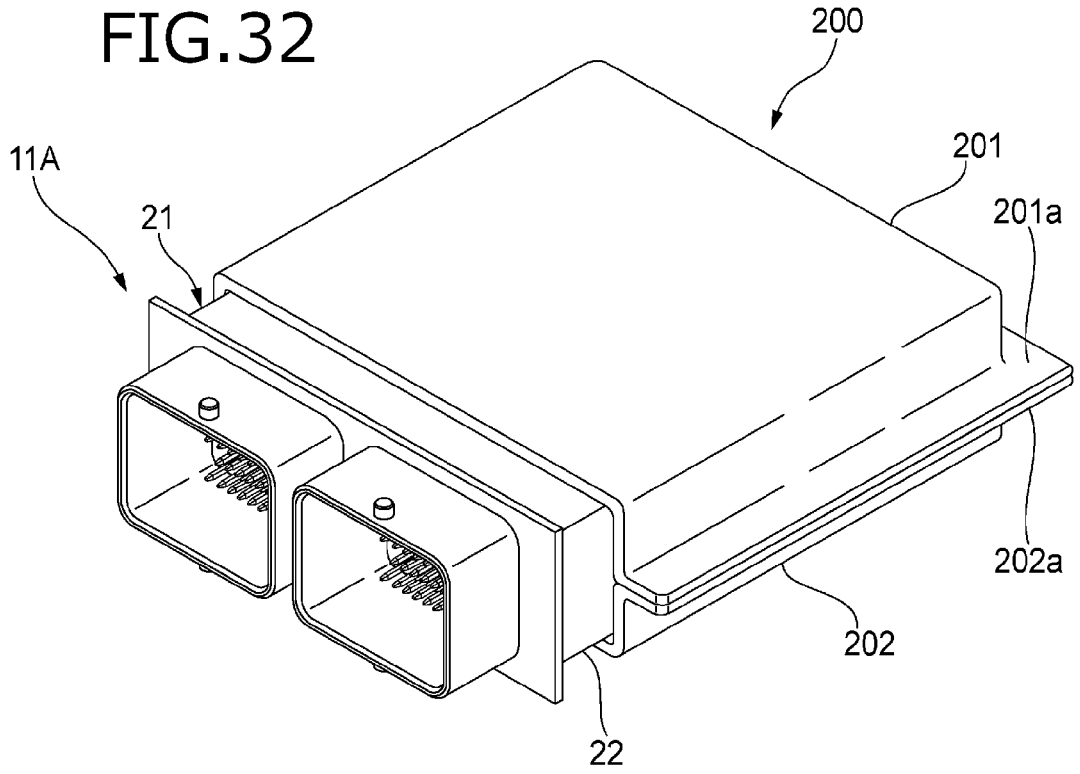
FIG. 32 is a perspective view showing a state in which a waterproof case is attached to the connector according a modification of the fifth embodiment.

More specifically, as shown in FIG. 32, the connector 11A according to this modification is equipped with the case 200 installed so as to enclose the terminal holding section 22 of the housing 21 and the circuit board 1 (refer to FIG. 4), not shown. The case 200 is configured so that the terminal holding section 22 and the circuit board 1 are held between an upper case 201 and a lower case 202 and so that the circuit board 1 (and the terminals inside the terminal holding section 22, refer to FIG. 2, etc.) is accommodated in the space (the internal space) defined by the terminal holding section 22, the upper case 201 and the lower case 202. The case 200 is fixed to the housing 21 by bonding the outer peripheral face of the terminal holding section 22 to the inner peripheral faces of the upper case 201 and the lower case 202 and by bonding the rib 201*a* of the upper case 201 to the rib 202*a* of the lower case 202. Since the case 200 is fixed as described above, the circuit board 1, the terminals (refer to FIG. 2, etc.) and other parts inside the terminal holding section 22 of the connector 11A are isolated from the surroundings, whereby these members are waterproofed and protected against impact and the like from the outside.

Figure 33:
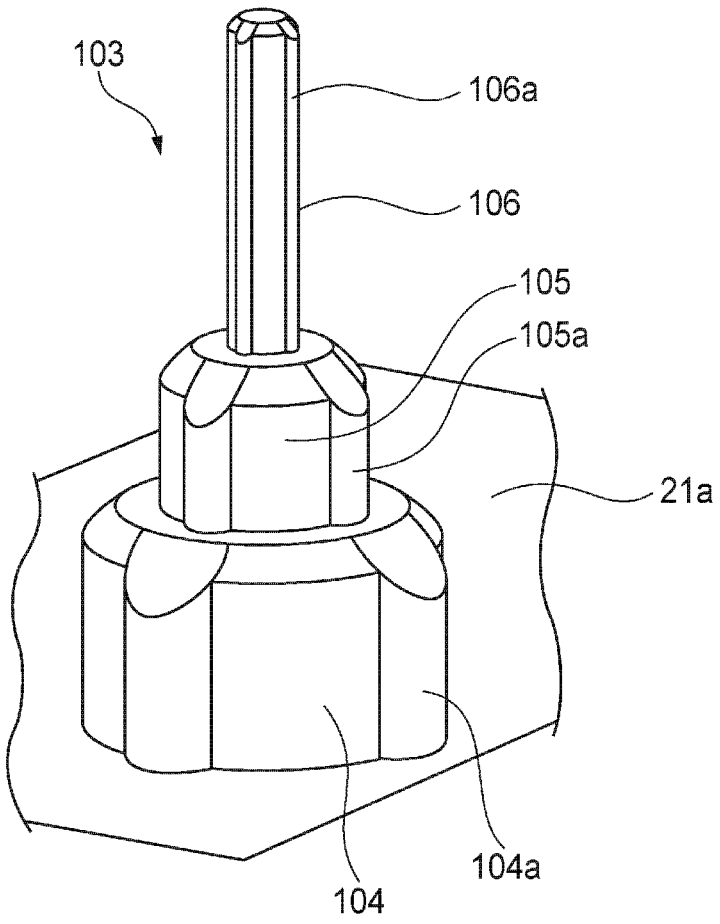
FIG. 33 is an enlarged view showing the protruding section of the housing shown in FIG. 34.

As shown in FIG. 33, in this modification, the protruding section 103 provided on the housing 21 is further equipped with a third step section 106 extending from the second step section 105 in addition to the above-mentioned first step section 104 and the above-mentioned second step section 105. Like the first step section 104 and the second step section 105, the third step section 106 extends from the bottom face 21*a* of the housing 21 to the mounting side (the lower side shown in FIG. 34 and described later) toward the circuit board 1. The diametric size of the third step section 106 is further smaller than that of the second step section 105. As in the first step section 104 and the second step section 105, convex sections 106*a* protruding outward in the radial direction are formed at a plurality of places in the circumferential direction.

Figure 34:
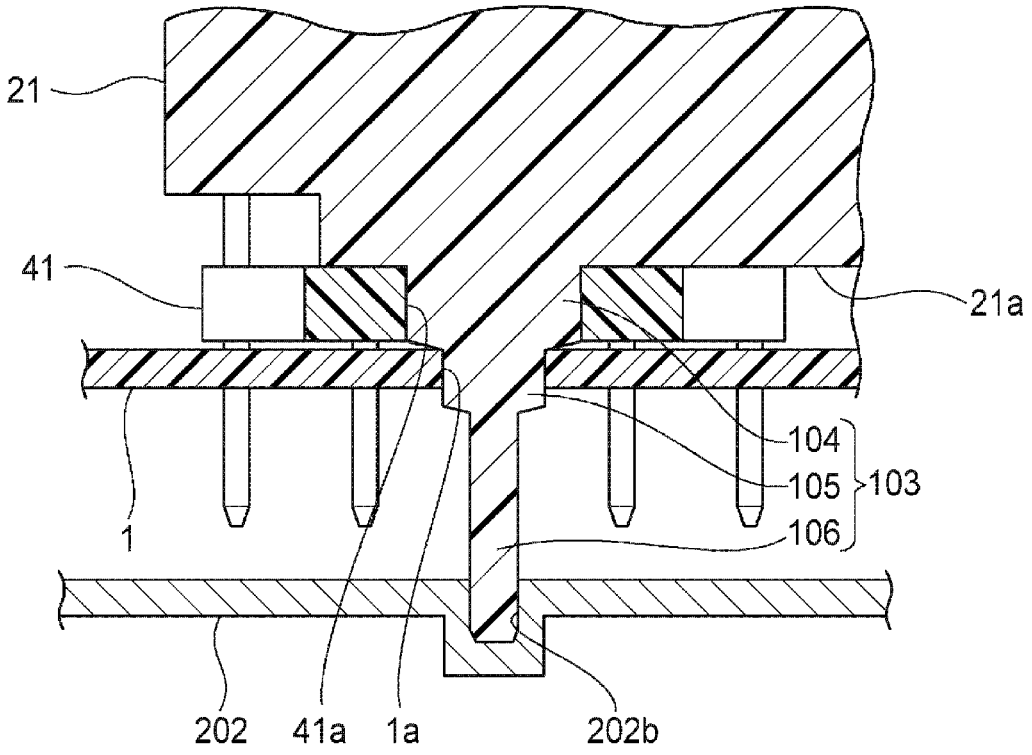
FIG. 34 is a main cross-sectional view showing an assembled state of the housing and the aligning plate of the connector with the circuit board and the waterproof case according to the modification of the fifth embodiment.

As shown in FIG. 34, the first step section 104 of the protruding section 103 is press-fitted into the through hole 41*a* formed in the aligning plate 41, and the second step section 105 thereof is press-fitted into the mounting hole 1*a* (the through hole in this modification) formed in the circuit board 1. Furthermore, the third step section 106 of the protruding section 103 is press-fitted into the mounting groove 202*b* (the concave section) formed in the inner wall face of the lower case 202. As a result, the aligning plate 41 and the circuit board 1 are fixed to the housing 21, and the housing 21 is fixed to the lower case 202.

With the engaging structure according to this modification, the single protruding section 103 is used to fix the plurality of members (the housing 21, the aligning plate 41, the circuit board 1 and the lower case 202). Hence, the assembling errors of the respective members are made small in comparison with the case in which the members are fixed using, for example, a plurality of (separated) engaging sections. As a result, the positional displacement between the through hole 2 of the circuit board and the terminal 31 can be made small, whereby the work for mounting the connector 11A on the circuit board 1 is made easy. Moreover, the number of the engaging sections can be reduced in comparison with the case in which the members are fixed using, for example, a plurality of engaging sections, whereby the connector 11A can be made more compact and the manufacturing cost of the connector 11A can be reduced.

Reference Example of the Fifth Embodiment

Figure 35A:
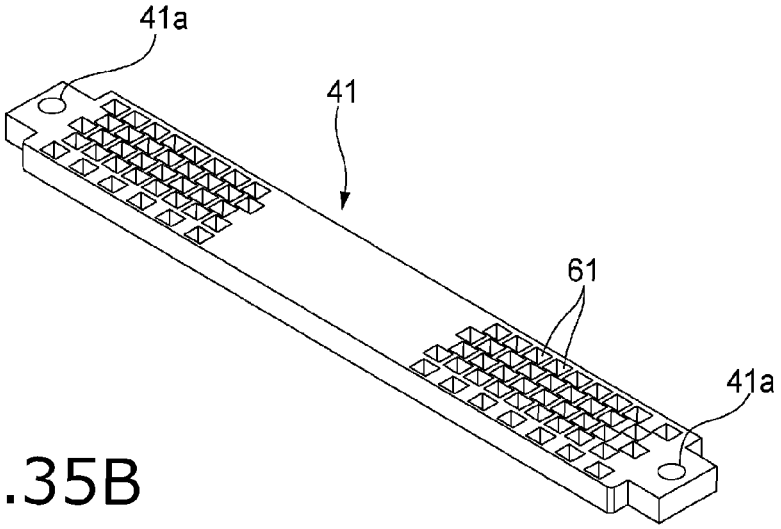
FIGS. 35A to 35C are perspective views showing examples indicating the arrangement of the through holes provided in aligning plates according to a reference example (a third reference example) of the fifth embodiment, the through holes being different in arrangement.
Figure 35B:
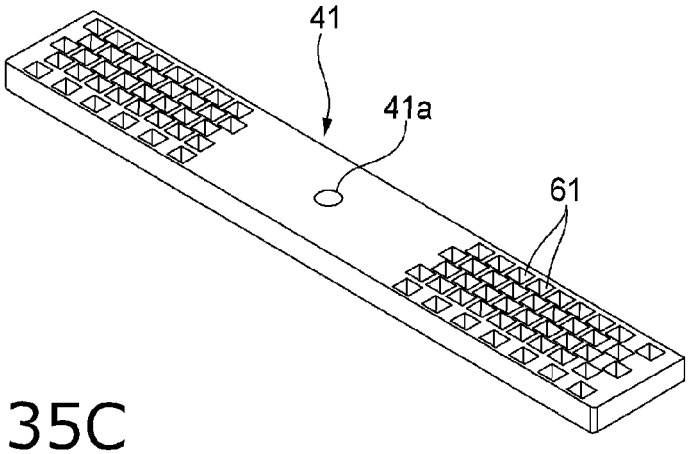
Figure 35C:
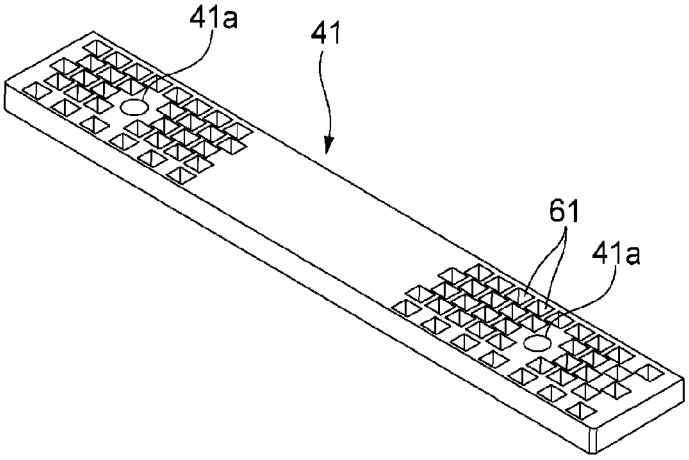

FIGS. 35A to 35C show aligning plates 41 according to a reference example (a third reference example) according to the fifth embodiment.

As shown in FIGS. 35A to 35C, these aligning plates 41 are different from the modifications (refer to FIGS. 29A to 29C and FIGS. 31 to 34) in that they do not have the convex-shaped section 51. In other words, the lower face of each of the aligning plate 41 is flat over the whole region, and a portion capable of functioning as a "relief section" for avoiding interference with the mounting component P on the circuit board 1 during mounting onto the circuit board 1 does not exist.

Even such an aligning plate 41 having no "relief section" as described above can also be applied to the engaging structures (more specifically, the engaging structure composed of the protruding section 103 provided on the housing 21, the through hole 41*a* provided in the aligning plate 41 and the mounting hole 1*a* provided in the circuit board 1; and the engaging structure having the mounting groove 202*b* of the case 200 additionally provided for the above-mentioned engaging structure) according to the fifth embodiment and the modification of the fifth embodiment.

Sixth Embodiment

Next, a connector according to a sixth embodiment will be described referring to FIGS. 36A to 36C and FIGS. 37 and 38. The connector according to the sixth embodiment differs from the connector according to the first embodiment mainly in the shape of the positioning hole 61. The shape of the positioning hole 61 of the aligning plate 41 according to the sixth embodiment is mainly described below. FIGS. 36A to 36C and FIGS. 37 and 38 are views illustrating the shapes of the positioning holes 61 provided in the aligning plate 41.

Figure 36A:
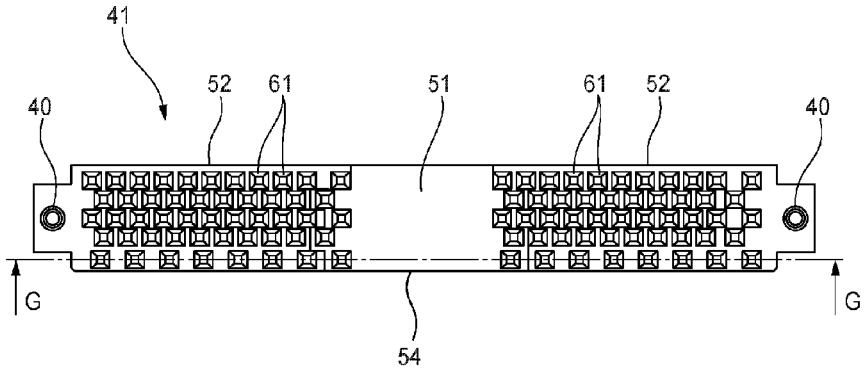
FIGS. 36A to 36C are views illustrating the shape of the positioning holes provided in the aligning plate of a connector according to a sixth embodiment.

As shown in FIG. 36A, the aligning plate 41 has a plate shape and has a plurality of positioning holes 61 passing through the aligning plate 41 in the depth direction. The terminals 31 (more specifically, the mounting terminal sections 31*b* of the terminals 31) fixed to the housing 21 are inserted into the positioning holes 61.

Figure 36B:
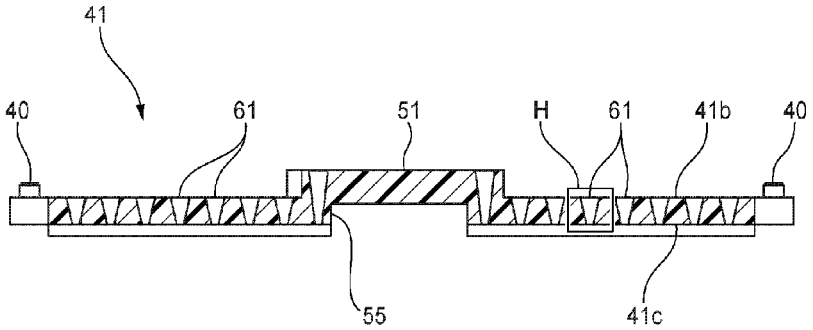
Figure 36C:
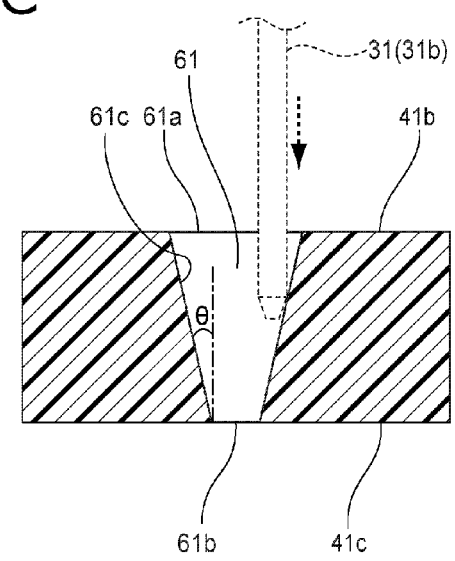

As shown in FIGS. 36B and 36C, the aligning plate 41 has a first side face 41*b* (a first face) and a second side face 41*c* (a second face). The second side face 41*c* (the second face) is a side face on the mounting side of the aligning plate 41 opposed to the circuit board 1 during mounting onto the circuit board 1, and the first side face 41*b* (the first face) is the side face on the opposite side of the side face on the mounting side. The positioning hole 61 has an opening section 61*a* on the first side face 41*b* and has an opening section 61*b* on the second side face 41*c*.

The shape of the positioning hole 61 will be described below. First, the opening area on the second side face 41*c* (the opening area of the opening section 61*b*) is smaller than the opening area on the first side face 41*b* (the opening area of the opening section 61*a*). Furthermore, the wall face 61*c* of the positioning hole 61 connects the opening edge on the first side face 41*b* (the opening edge of the opening section 61*a*) to the opening edge on the second side face 41*c* (the opening edge of the opening section 61*b*) and is inclined with respect to the mounting direction (the up-down direction in FIG. 36C). In other words, the wall face 61*c* of the positioning hole 61 is wholly inclined with respect to the mounting direction.

Figure 37:
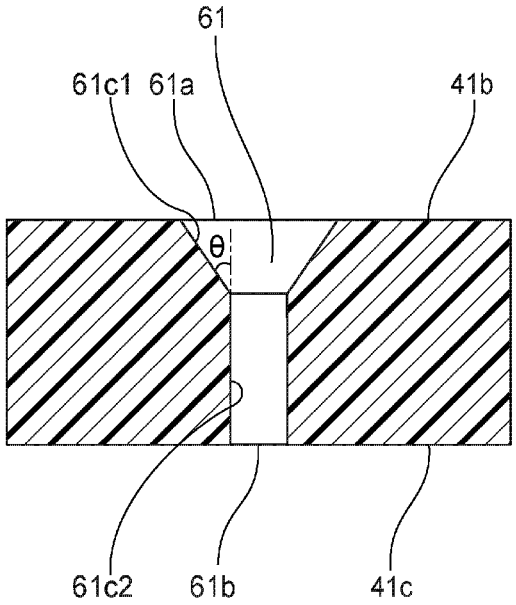
FIG. 37 is a view illustrating the shape of the positioning hole provided in the aligning plate according to the first embodiment.

On the other hand, as shown in FIG. 37, the positioning hole 61 (also refer to FIG. 8) provided in the aligning plate 41 according to the first embodiment has a wall face 61*c*1 (the upper portion of the hole shown in FIG. 37) inclined with respect to the mounting direction and a wall face 61*c*2 (the lower portion of the hole shown in FIG. 37) being nearly parallel to the mounting direction. However, the opening areas of the opening section 61*a* and the opening section 61*b* of the positioning hole 61 according to the first embodiment are respectively the same as those according to the sixth embodiment. Hence, the inclination angle θ of the wall face 61*c*1 in the first embodiment is larger than the inclination angle θ (refer to FIG. 36C) of the wall face 61*c* in the sixth embodiment. The inclination angle θ of the wall face 61*c*1 in the first embodiment is nearly equal to the inclination angle in aligning plates generally used for the above-mentioned conventional connectors and is approximately 45 degrees.

Conversely, the inclination angle θ (refer to FIG. 36C) of the positioning hole 61 according to the sixth embodiment is caused by the above-mentioned shape of the hole and is smaller than the inclination angle θ (refer to FIG. 37) of the positioning hole 61 according to the first embodiment, although the opening areas of the opening section 61*a* and the opening section 61*b* of the positioning hole 61 according to the sixth embodiment are respectively the same as those according to the first embodiment. More specifically, in the case of the positioning hole 61 according to the sixth embodiment, the inclination angle θ of the wall face 61*c* can be minimized without changing the opening areas of the opening section 61*a* and the opening section 61*b* (in other words, without significantly changing the entire structure of the aligning plate 41). According to examinations and investigations, etc. conducted by the inventors of the present invention, the inclination angle θ of the wall face 61*c* in the sixth embodiment can be made smaller to 25 degrees or less (in the case that the opening section 61*a* and the opening section 61*b* having general sizes are provided for the aligning plate 41 having a general thickness).

As shown in FIG. 36C, when the terminal 31 is inserted into the positioning hole 61, as the inclination angle θ of the wall face 61*c* is smaller, the friction force between the tip end of the terminal 31 advancing in the mounting direction (the arrow direction in the figure) and the wall face 61*c* can be made smaller. The reason for this is because the vertical stress exerted by the terminal 31 to the wall face 61*c* at the contact point between the terminal 31 and the wall face 61*c* becomes lower as the inclination angle θ of the wall face 61*c* is smaller. The friction force is calculated as the product of the friction coefficient and the vertical stress at the contact point.

The aligning plate 41 can be easily assembled with the terminals 31 (and eventually with the housing 21) by virtue of the above-mentioned reduction in friction force. As a result, assembling workability can be improved. In particular, this easiness of the assembling work contributes to the improvement in the workability more greatly as the number of the terminals 31 is larger (because the problem in which the total of the friction forces becomes excessive and the assembling work itself of the aligning plate 41 becomes impossible can be prevented).

Figure 38:
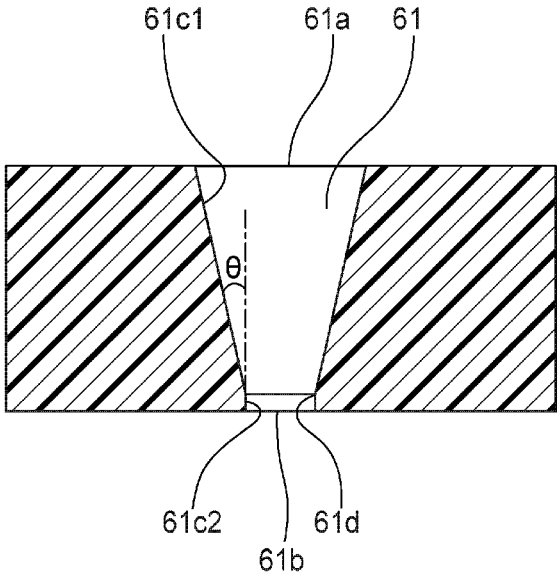
FIG. 38 is a view illustrating another example of the shape of the positioning hole provided in the aligning plate according to the sixth embodiment.

Moreover, as understood from the above explanation, as in the example shown in FIG. 38, even in the case that the wall face 61*c*1 of the positioning hole 61 connects the opening edge of the opening section 61*a* to the wall face 61*d* in the vicinity of the opening edge of the opening section 61*b* (in other words, even if a wall face 61*c*2 nearly parallel with the mounting direction exists slightly in the vicinity of the opening section 61*b*), the assembling workability can be improved as described above. According to examinations and investigations, etc. conducted by the inventors of the present invention, within a range in which the inclination angle θ of the wall face 61*c*1 is 25 degrees or less, the assembling workability can be improved sufficiently even if the wall face 61*c*2 exists in the vicinity of the opening section 61*b*. Hence, the above-mentioned "in the vicinity" can be paraphrased as within a range in which the inclination angle θ of the wall face 61*c*1 is 25 degrees or less.

Another Reference Example

Next, a connector according to a fourth reference example will be described. The same components as those according to the first embodiment are designated by the same numerals and their descriptions are omitted.

Figure 39:
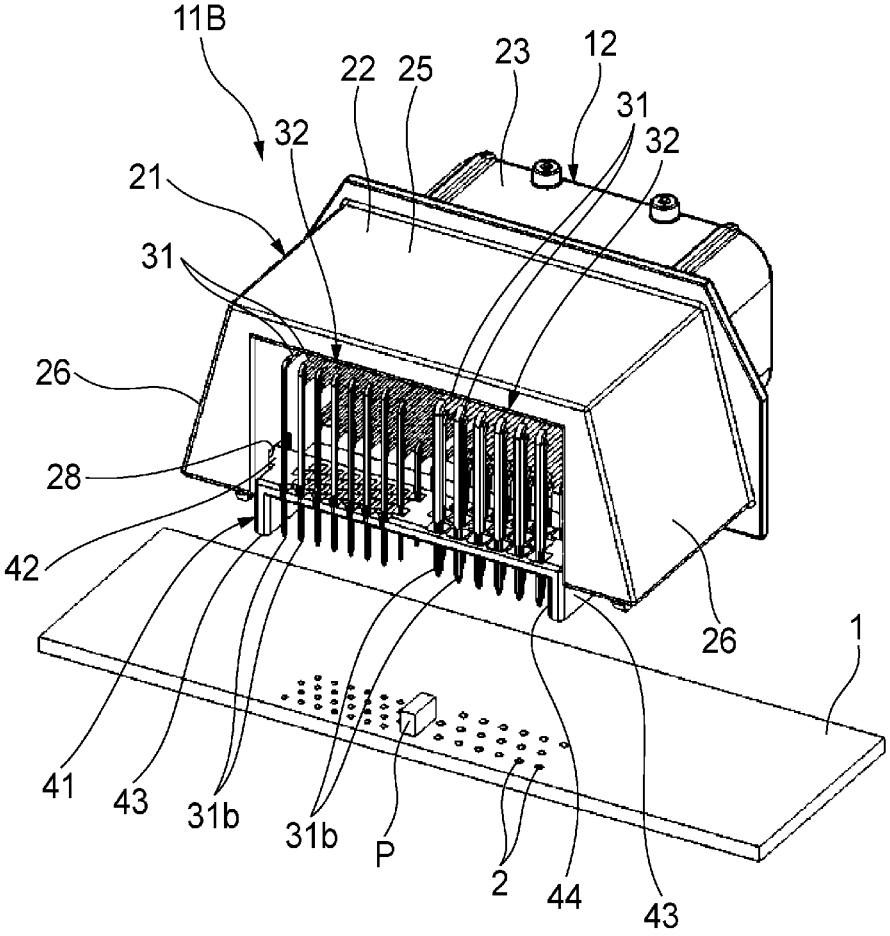
FIG. 39 is a perspective view illustrating a connector according to a fourth reference example as viewed from the rear.
Figure 40:
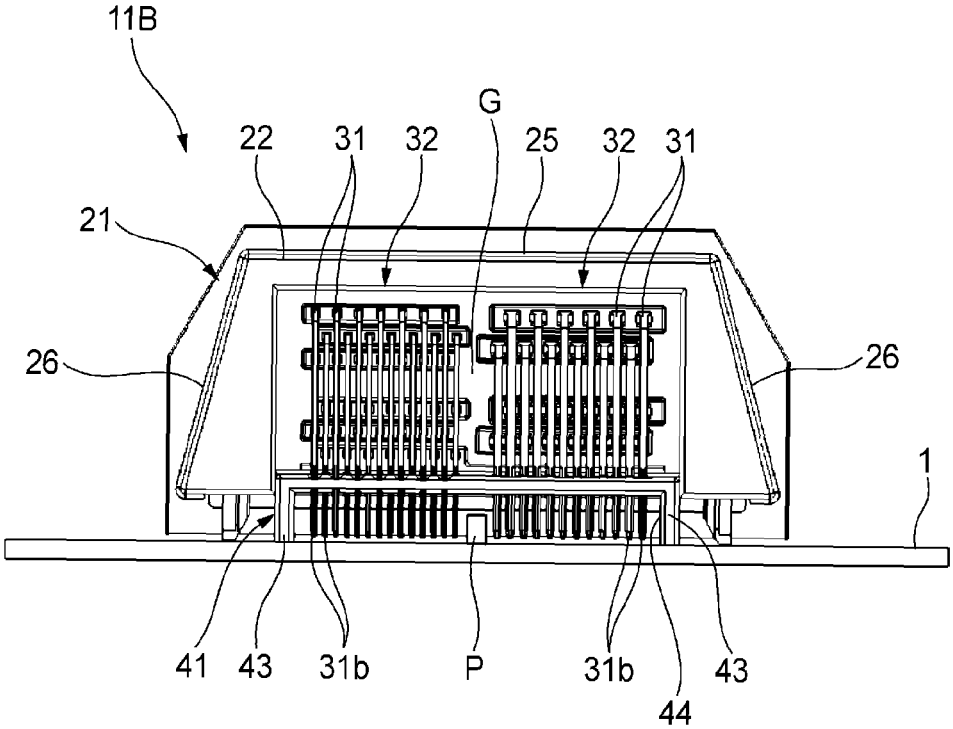
FIG. 40 is a bottom view illustrating the connector according to the fourth reference example.
Figure 41:
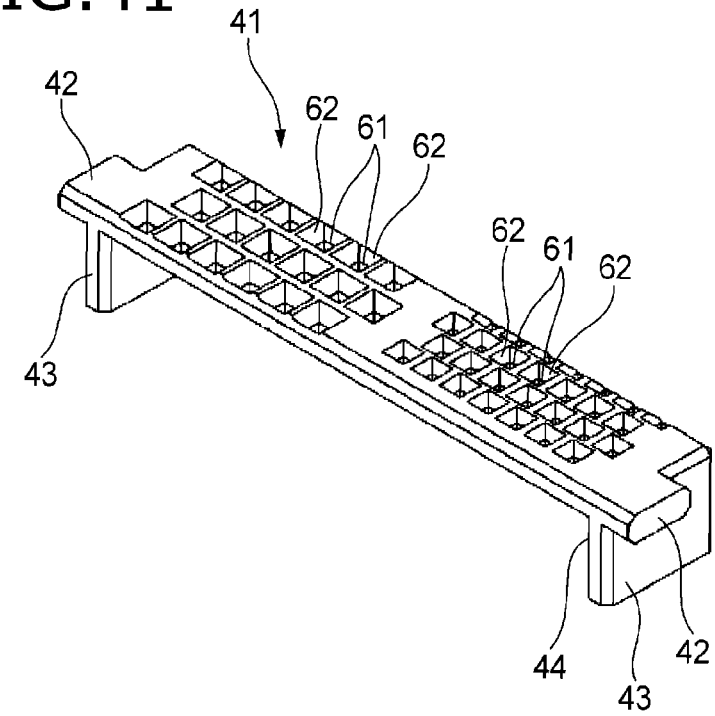
FIG. 41 is a perspective view showing an aligning plate constituting the connector.
Figure 42A:
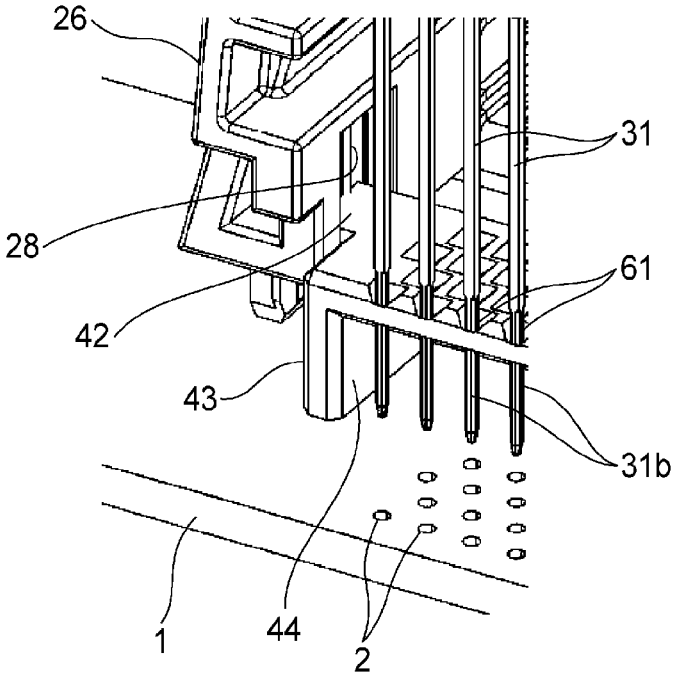
FIGS. 42A and 42B are views illustrating the movement of the aligning plate with respect to the housing of the connector and are respectively partially perspective views as viewed from the rear side.
Figure 42B:
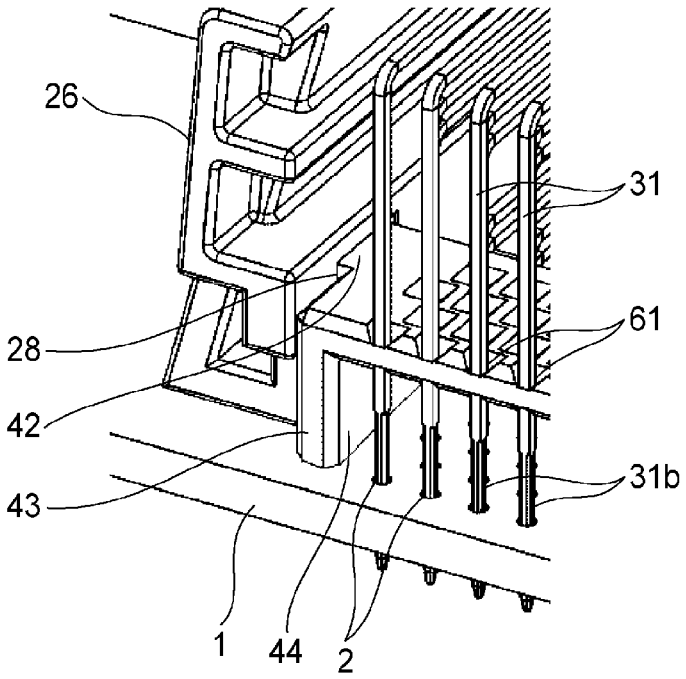
Figure 43:
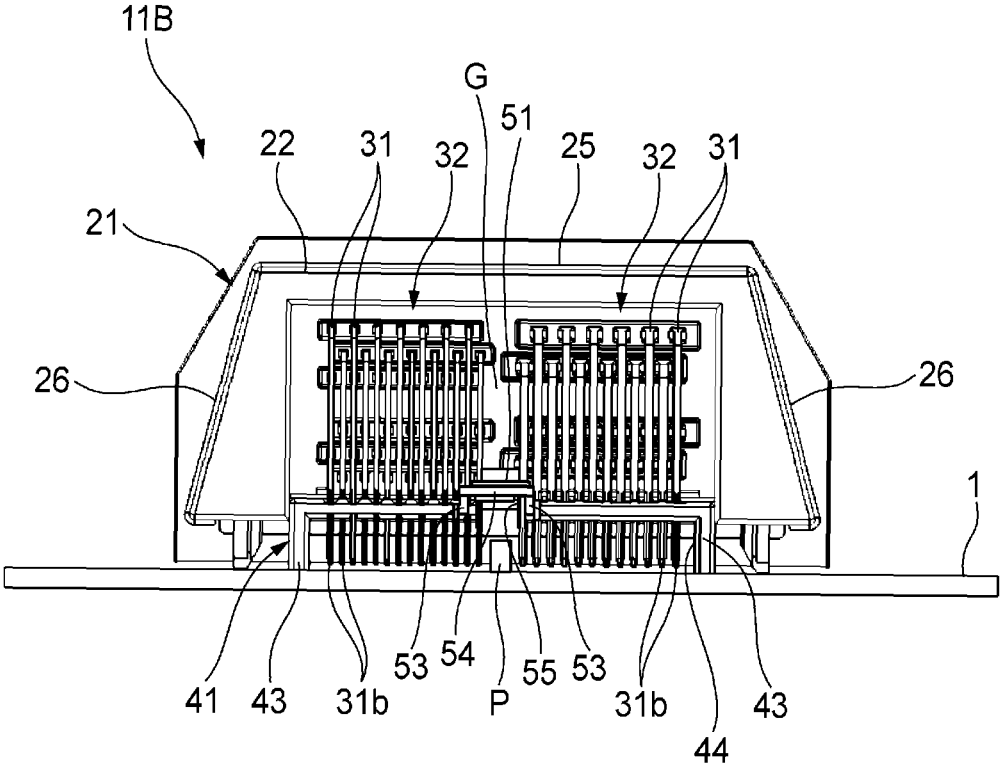
FIG. 43 is a bottom view illustrating a connector according to a modification of the fourth reference example.

FIG. 39 is a perspective view illustrating a connector according to a fourth reference example as viewed from the rear. FIG. 40 is a bottom view illustrating the connector according to the fourth reference example. FIG. 41 is a perspective view showing an aligning plate constituting the connector. FIGS. 42A and 42B are views illustrating the movement of the aligning plate with respect to the housing of the connector and are respectively partially perspective views as viewed from the rear side. FIG. 43 is a bottom view illustrating a connector according to a modification of the fourth reference example.

As shown in FIGS. 39 and 40, a connector 11B according to the fourth reference example is also a board-mounting connector to be mounted on the circuit board 1. In this connector 11B, the aligning plate 41 is provided so as to be movable in the up-down direction with respect to the housing 21. The connector 11B has a single joint section 12, and a mating connector is joined to this joint section 12.

In the housing 21, slide grooves 28 extending in the up-down direction are formed on the sides of the inner faces opposed to the side plates 26 for covering both sides of the terminals 31.

As shown in FIG. 41, engaging protrusions 42 are formed at both end sections of the aligning plate 41. Furthermore, side wall sections 43 protruding downward in the mounting direction toward the circuit board 1 are formed at both end sections of the aligning plate 41. As a result, a concave section 44 is formed on the mounting side of the aligning plate 41 toward the circuit board 1.

The aligning plate 41 is mounted on the housing 21 in a state in which the engaging protrusions 42 are engaged with the slide grooves 28 of the housing 21. Hence, the aligning plate 41 is supported so as to be movable in the up-down direction with respect to the housing 21. The aligning plate 41 is moved in the up-down direction between the terminal protection position disposed at the lower ends of the slide grooves 28 and the terminal mounting position disposed at the upper ends of the slide grooves 28. Furthermore, the housing 21 is provided with locking sections (not shown) such as pawls in the slide grooves 28. The locking sections are used to lock the aligning plate 41 having been moved to the terminal mounting position, thereby holding the aligning plate 41 at the terminal mounting position without causing rattling.

As shown in FIG. 42A, in a state in which the aligning plate 41 is disposed at the terminal mounting position, the tip end portions of the mounting terminal sections 31*b* of the terminals 31 are in a state of being inserted in the positioning holes 61 of the aligning plate 41. Furthermore, the side wall sections 43 of the aligning plate 41 are in a state of being protruded downward so as to be lower than the mounting terminal sections 31*b* of the terminals 31. Hence, the tip end portions of the mounting terminal sections 31*b* of the terminals 31 are held with the aligning plate 41 and disposed within the concave section 44 of the aligning plate 41. As a result, the tip end portions of the mounting terminal sections 31*b* of the terminals 31 are arranged by the aligning plate 41, and the circumferences thereof are enclosed and protected by the aligning plate 41, whereby external impact, for example, caused due to interference with other parts, etc. is suppressed.

As shown in FIG. 42B, in a state in which the aligning plate 41 is disposed at the terminal mounting position, when the aligning plate 41 is moved upward to the housing 21, the mounting terminal sections 31*b* of the terminals 31 move downward relatively with respect to the aligning plate 41. Hence, the mounting terminal sections 31*b* of the terminals 31 are in a state of being protruded downward significantly from the aligning plate 41, whereby the mounting terminal sections 31*b* of the terminals 31 having been protruded from the aligning plate 41 can be inserted into the through holes 2 of the circuit board 1.

In the case that the connector 11B according to the fourth reference example is mounted on the circuit board 1, the connector 11B in which the aligning plate 41 is disposed at the terminal protection position is brought close to the connector mounting position on the circuit board 1 from above and is mounted thereon (refer to FIG. 40). At this time, since the circumferences of the tip end portions of the mounting terminal sections 31*b* of the terminals 31 are disposed and protected inside the concave section 44 of the aligning plate 41, external impact, for example, caused due to interference with other parts, etc. is suppressed. Moreover, since the side wall sections 43 of the aligning plate 41 are protruded downward so as to be lower than the mounting terminal sections 31*b* of the terminals 31, when the aligning plate 41 is mounted on the circuit board 1, the side wall sections 43 of the aligning plate 41 make contact with the surface of the circuit board 1. This prevents impact due to the contact of the tip ends of the mounting terminal sections 31*b* of the terminals 31 with the surface of the circuit board 1. In addition, since the side wall sections 43 of the aligning plate 41 make contact with the surface of the circuit board 1, a mounting space S is formed between the aligning plate 41 and the circuit board 1, more specifically, between the concave section 44 on the mounting side toward the circuit board 1 and the surface of the circuit board 1. Hence, the aligning plate 41 does not interfere with the mounting component P mounted on the circuit board 1.

Next, the housing 21 is pushed toward the circuit board 1 while the positions of the mounting terminal sections 31*b* of the terminals 31 are aligned with those of the through holes 2 of the circuit board 1. Then, as shown in FIG. 42B, the aligning plate 41 moves upward relatively with respect to the housing 21, whereby the mounting terminal sections 31*b* of the terminals 31 protrude downward with respect to the aligning plate 41 and are inserted into the through holes 2. When the aligning plate 41 is disposed at the terminal mounting position of the housing 21, the aligning plate 41 is locked to the housing 21 by the locking sections of the slide grooves 28 and is held without rattling.

The mounting terminal sections 31*b* of the terminals 31 having been inserted into the through holes 2 are then soldered. Since the aligning plate 41 is disposed so as to have a space between the aligning plate and the circuit board 1 at this time, the aligning plate 41 does not interfere with the solder fillet sections F rising from the surface of the circuit board 1.

In the case of the connector 11B according to the fourth reference example described above, since the side wall sections 43 are provided at both ends so that the aligning plate 41 is formed into a convex shape, the strength of the aligning plate 41 can be raised easily, whereby the aligning plate 41 can be suppressed from being warped during molding. Furthermore, the mounting component P can be mounted onto the circuit board 1 so that the mounting component P is disposed in the mounting space S between the circuit board 1 and the concave section 44 on the mounting side of the aligning plate 41 toward the circuit board 1.

Moreover, since the aligning plate 41 is disposed at the terminal protection position, the peripheries of the tip end portions of the mounting terminal sections 31*b* of the terminals 31 are enclosed and protected by the aligning plate 41, whereby external impact, for example, caused due to interference with other parts, etc. can be suppressed. What's more, since the housing 21 is brought close to the circuit board 1, the side wall sections 43 of the aligning plate 41 are made contact with the circuit board 1, and the aligning plate 41 is disposed at the terminal mounting position, the tip end portions of the mounting terminal sections 31*b* of the terminals 31 can be protruded beyond the concave section 44 to the mounting side of the aligning plate 41 toward the circuit board 1 and can be inserted into the through holes 2.

As a result, the aligning plate 41 can be smoothly mounted onto the circuit board 1 while damages such as deformation of the terminals 31 are prevented before the mounting of the aligning plate 41 onto the circuit board 1.

Also in the fourth reference example, as shown in FIG. 43, a convex-shaped section 51 protruding to the mounting side of the aligning plate 41 toward the housing 21 may be formed at the central portion of the aligning plate 41 in the longitudinal direction. In the case of the aligning plate 41 having the convex-shaped section 51, the strength of the aligning plate 41 can be enhanced further by the convex-shaped section 51, and the aligning plate 41 can be suppressed from being warped during molding. Hence, the mounting terminal sections 31*b* of the terminals 31 can be positioned and arranged accurately by inserting the mounting terminal sections 31*b* of the terminals 31 into the positioning holes 61 of the aligning plate 41.

Still further, when the aligning plate 41 is mounted on the circuit board 1, the height of the mounting space S at the central portion of the aligning plate 41 in the longitudinal direction can be made larger, and the interference with the mounting component P disposed in the mounting space S can be avoided more securely.

Other Embodiments

However, the present invention is not limited to the above-mentioned respective embodiments, but various modifications can be adopted within the scope of the present invention. For example, the present invention is not limited to the above-mentioned embodiments, but can be modified or improved as necessary. In addition, the materials, shapes, dimensions, quantities, arrangement positions, etc. of the respective components in the above-mentioned embodiments may be arbitrary and not limited, provided that the present invention can be achieved.

The characteristics of the connector according to the embodiments of the present invention described above will be briefly summarized and listed in the following items (1) to (8).

(1) There is provided a connector including: a housing (21), a plurality of terminals (31) installed in the housing, and an aligning plate (41) configured to be installed in the housing and having a plurality of positioning holes (61) into which the terminals are inserted, wherein the connector is configured to be mounted on a circuit board (1) so that the terminals inserted into the positioning holes are inserted into the through holes (2) of the circuit board; wherein the aligning plate has a first face and a second face on the opposite side of the first face, the second face being opposed to the circuit board during mounting onto the circuit board; wherein the aligning plate (41) has a stepped shape including a plurality of faces (51 and 61) being different in position in the mounting direction (the up-down direction in FIG. 4) toward the circuit board on the first face (the upper face in FIG. 4); and the aligning plate has a relief section (55) provided on the second face (the lower face in FIG. 4) to avoid interference with a mounting component (P) on the circuit board.

(2) The connector described in the above-mentioned item (1), wherein the aligning plate (41) has a concave section (55) serving as the relief section and is provided on the second face (the lower face) at the position opposed to the mounting component; and wherein the aligning plate has a convex-shaped section (51) having the stepped shape and is provided on the first face (the upper face) at a position corresponding to the concave section.

(3) The connector described in the above-mentioned item (2), wherein during mounting onto the circuit board (1), the second face (the lower faces of 52) other than the concave section (55) in the aligning plate is positioned closer to the surface of the circuit board (1) than the upper face of the mounting component (P) and also positioned more away from the surface of the circuit board than solder fillet sections (F) formed around the through holes (2) of the circuit board; and wherein during mounting onto the circuit board (1), the concave section (55) of the second surface in the aligning plate is positioned more away from the circuit board (1) than the upper face of the mounting component (P).

(4) The connector described in any one of the above-mentioned items (1) to (3), wherein the aligning plate (41) has a plate shape; wherein the stepped shape is a shape in which plural faces (71 to 73) being different in position in the mounting direction (the up-down direction in FIG. 12) are arranged in the width direction (the left-right direction in FIG. 12) of the aligning plate; and wherein the positioning holes (61) are provided in the respective faces (71 to 73) constituting the stepped shape.

(5) The connector described in any one of the above-mentioned items (1) to (3), wherein the aligning plate (41) has a plate shape; wherein the stepped shape is a shape in which plural faces (81 to 83) being different in position in the mounting direction (the up-down direction in FIG. 13) are arranged in the depth direction (the front-rear direction in FIG. 13) orthogonal to the width direction of the aligning plate; and wherein the positioning holes (61) are provided in the respective faces (81 to 83) constituting the stepped shape.

(6) The connector described in any one of the above-mentioned items (1) to (5), wherein the aligning plate (41) has a plate shape and also has wall sections (96 to 99) protruding from the first face (the upper face) along the mounting direction (the up-down direction in FIG. 23) and extending in the width direction (the left-right direction in FIG. 23) of the aligning plate; and wherein the positioning holes (61) are arranged along the wall sections (96 to 99) in the width direction (the left-right direction in FIG. 23) of the aligning plate.

(7) The connector described in any one of the above-mentioned items (1) to (6), wherein the aligning plate (41) has a plate shape and also has one or more through holes (41*a*); wherein the housing (21) has one or more protruding sections (103) protruding along the mounting direction (the up-down direction in FIG. 30) at the positions corresponding to the through holes (41*a*) on the second face; and wherein each of the one or more protruding sections (103) has a first step section (104) having a diameter corresponding to a diameter of the through hole (41*a*) and a second step section (105) having a diameter corresponding to a diameter of the mounting hole (1*a*) provided in the circuit board.

(8) The connector described in any one of the above-mentioned items (1) to (7), wherein each of the positioning holes (61) has a shape in which an opening area on the second face (41*c*) is smaller than an opening area on the first face (41*b*) and in which a wall face (61*c*) connects an opening edge (the opening edge of 61*a*) on the first face to an opening edge (the opening edge of 61*b*) on the second face or to a wall face (61*d*) in the vicinity of the opening edge on the second face and which is inclined with respect to the mounting direction (the up-down direction in FIG. 36).

What is claimed is:

1. A connector comprising:

a housing;

a plurality of terminals installed in the housing; and an aligning plate configured to be installed in the housing and having a plurality of positioning holes into which the terminals are inserted, wherein the connector is configured to be mounted on a circuit board so that the terminals inserted into the positioning holes are inserted into the through holes of the circuit board;

wherein the aligning plate has a first face and a second face on the opposite side of the first face, the second face being opposed to the circuit board during mounting onto the circuit board;

wherein the aligning plate has a stepped shape including a plurality of faces being different in position in the mounting direction toward the circuit board on the first face;

wherein the aligning plate has a relief section provided on the second face to avoid interference with a mounting component on the circuit board during mounting onto the circuit board; and wherein during mounting onto the circuit board, a portion of the second face through which a subset of the positioning holes pass is closer to a surface of the circuit board than the relief section.

2. The connector according to claim 1, wherein the aligning plate has a concave section serving as the relief section and is provided on the second face at the position opposed to the mounting component; and wherein the aligning plate has a convex-shaped section having the stepped shape and is provided on the first face at a position corresponding to the concave section.

3. The connector according to claim 2 wherein during mounting onto the circuit board, the second face other than the concave section in the aligning plate is positioned closer to the surface of the circuit board than the upper face of the mounting component and also positioned more away from the surface of the circuit board than solder fillet sections formed around the through holes of the circuit board; and wherein during mounting onto the circuit board, the concave section of the second surface in the aligning plate is positioned more away from the circuit board than the upper face of the mounting component.

4. The connector according to claim 1, wherein the aligning plate has a plate shape;

wherein the stepped shape is a shape in which plural faces being different in position in the mounting direction are arranged in the width direction of the aligning plate; and wherein the positioning holes are provided in the respective faces constituting the stepped shape.

5. The connector according to claim 1, wherein the aligning plate has a plate shape;

wherein the stepped shape is a shape in which plural faces being different in position in the mounting direction are arranged in the depth direction orthogonal to the width direction of the aligning plate; and wherein the positioning holes are provided in the respective faces constituting the stepped shape.

6. The connector according to claim 1, wherein the aligning plate has a plate shape and wall sections protruding from the first face along the mounting direction and extending in the width direction of the aligning plate; and wherein the positioning holes are arranged along the wall sections in the width direction of the aligning plate.

7. The connector according to claim 1, wherein the aligning plate has a plate shape and one or more through holes;

wherein the housing has one or more protruding sections protruding along the mounting direction at the positions corresponding to the through holes on the second face; and wherein each of the one or more protruding sections has a first step section having a diameter corresponding to a diameter of the through hole and a second step section having a diameter corresponding to a diameter of the mounting hole provided in the circuit board.

8. The connector according to claim 1, wherein each of the positioning holes has a shape in which an opening area on the second face is smaller than an opening area on the first face and has a wall face which connects an opening edge on the first face to an opening edge on the second face or to a wall face in the vicinity of the opening edge on the second face and which is inclined with respect to the mounting direction.

* * * * *